US009406268B2

(12) United States Patent
Imada

(10) Patent No.: US 9,406,268 B2
(45) Date of Patent: Aug. 2, 2016

(54) METHOD FOR DRIVING INFORMATION PROCESSING DEVICE AND PROGRAM AND INFORMATION PROCESSING DEVICE

(71) Applicant: Semiconductor Energy Laboratory Co., Ltd., Atsugi-shi, Kanagawa-ken (JP)

(72) Inventor: Jiro Imada, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 0 days.

(21) Appl. No.: 14/090,236

(22) Filed: Nov. 26, 2013

(65) Prior Publication Data

US 2014/0152533 A1 Jun. 5, 2014

(30) Foreign Application Priority Data

Nov. 30, 2012 (JP) ..... 2012-261910

(51) Int. Cl.
*G09G 3/20* (2006.01)
*G09G 3/36* (2006.01)

(52) U.S. Cl.
CPC ..... *G09G 3/3648* (2013.01); *G09G 2320/0247* (2013.01); *G09G 2320/103* (2013.01); *G09G 2330/021* (2013.01); *G09G 2360/16* (2013.01)

(58) Field of Classification Search
CPC .. G06F 3/038; G09G 5/10; G09G 2320/0247; G09G 2320/103; G09G 2330/021; G09G 2360/16; G09G 2310/027; G09G 2310/0272; G09G 2310/0275; G09G 2310/0278; G09G 2310/0297; G09G 3/20; G09G 3/2803; G09G 3/288; G09G 3/2033; G09G 3/2037; G09G 2310/0245; G09G 2310/063; G09G 3/3618; G09G 3/3622; G09G 3/3625; G09G 3/3629; G09G 3/3637; G09G 3/3633; G09G 3/364; G09G 3/3644; G09G 3/3648; G09G 3/3655; G09G 3/3688; G09G 3/3692; G09G 3/3607; G09G 3/2003; G09G 3/367; G09G 3/3696
USPC ..... 345/204–206, 690–696, 208–210, 345/50–55, 87–94
See application file for complete search history.

(56) References Cited

U.S. PATENT DOCUMENTS

| | | | | |
|---|---|---|---|---|
| 2008/0252668 | A1* | 10/2008 | Chen | 345/690 |
| 2011/0090183 | A1 | 4/2011 | Yamazaki et al. | |
| 2011/0090204 | A1 | 4/2011 | Yamazaki et al. | |
| 2011/0149185 | A1 | 6/2011 | Yamazaki | |
| 2011/0199404 | A1* | 8/2011 | Umezaki et al. | 345/691 |

FOREIGN PATENT DOCUMENTS

JP 2011-186449 A 9/2011

OTHER PUBLICATIONS

Amano et al., "Low Power LC Display Using In—Ga—Zn—Oxide TFTs Based on Variable Frame Frequency," SID 10 Digest, 2010, pp. 626-629.
Nishi et al., "Possibility of Reflective LC Display Using Oxide Semiconductor TFTs as Electronic Paper Display," SID 10 Digest, 2010, pp. 1685-1688.
Godo et al., "Modeling and Measurement of Ultra-Low Leakage Current of IGZO TFTs and New Driving Method of LCDs," IDW '10, 2010, pp. 235-238.
Miyake et al., "New Driving Method for Reducing Eye Strain Technology (REST) in Displaying Still Image Using CAAC IGZO LC Display," SID 2013 Digest, pp. 935-938.

* cited by examiner

*Primary Examiner* — Lun-Yi Lao
*Assistant Examiner* — Jarurat Suteerawongsa
(74) *Attorney, Agent, or Firm* — Eric J. Robinson; Robinson Intellectual Property Law Office, P.C.

(57) ABSTRACT

In order to reduce the frequency of rewriting pixels, gray scales of image signals input to a plurality of pixels provided in a display portion are checked before displaying each image. Specifically, in the case where image signals having medium gray scale levels are input to many of the plurality of pixels, display is performed by normal driving (for example, driving in which rewriting pixels is performed at a frequency higher than or equal to 60 times per second); otherwise, display is performed by driving with a small number of frequencies of rewriting pixels (for example, driving in which rewriting pixels is performed at a frequency lower than or equal to once per second). With this method, an information processing device which can reduce users' eye strain and perform eye-friendly display can be provided.

14 Claims, 23 Drawing Sheets

METHOD FOR DRIVING INFORMATION PROCESSING DEVICE AND PROGRAM AND INFORMATION PROCESSING DEVICE

BACKGROUND OF THE INVENTION

1. Field of the Invention

The present invention relates to an object, a method, a manufacturing method, a process, a machine, manufacture, or composition of matter. In particular, the present invention relates to a semiconductor device, a display device, a light-emitting device, a method for driving them, or a method for manufacturing them, for example. In particular, the present invention relates to, for example, an information processing device and a method for driving it. The present invention relates to, for example, a program for driving an information processing device.

2. Description of the Related Art

There is a known technique for reducing power consumption in which a frequency of rewriting pixels (also referred to as a refresh rate) is reduced when a still image is displayed on a display portion.

REFERENCE

Patent Document

[Patent Document 1] Japanese Published Patent Application No. 2011-186449

SUMMARY OF THE INVENTION

An information processing device processes input information and displays an image based on the processed information on a display portion. In general, the display portion includes a pixel region including a plurality of pixels and displays an image on the pixel region. Further, image signals having the same gray scale are input at a frequency higher than 60 Hz, for example (in other words, refreshing is performed). Note that in this specification, an image signal is one of voltages corresponding to multi-gray scales (e.g., 256 gray scales), and is a signal for controlling the alignment of liquid crystal by its voltage. Users may get eye strain when watching a display portion which is switched at such a frequency for hours. Specifically, even in the case where input operation in which an image signal which has the same gray scale as an image signal held in a pixel is input to the pixel is performed, the voltage held in the pixel is changed due to the input of the image signal. In this case, the alignment of liquid crystal in the pixel is changed, so that the luminance of the pixel is changed. This change is recognized as a flicker of display by users in some cases. As a result, the users may feel eye strain.

In order to reduce eye strain, a method in which the frequency of rewriting images is reduced is effective. However, depending on the kind of displayed images, display may flicker even with the method.

Specifically, in the case where image signals having medium gray scale levels are input to many of the plurality of pixels provided in the display portion, display may flicker. This is because a change of a voltage corresponding to the image signal having a medium gray scale level heavily affects the alignment of the liquid crystal as compared to a change of a voltage corresponding to an image signal having another gray scale level (a low or high gray scale level) (e.g., a voltage corresponding to the first gray scale level or the $256^{th}$ gray scale level of 256 gray scales).

One object of one embodiment of the present invention is to suppress eye strain of users of an output device. Another object of one embodiment of the present invention is to perform eye-friendly display. Another object of one embodiment of the present invention is to perform display with a small number of flickers. Another object of one embodiment of the present invention is to perform clear display. Another object of one embodiment of the present invention is to display a clear still image. Another object of one embodiment of the present invention is to reduce power consumption of a display device.

Note that the descriptions of these problems do not disturb the existence of other problems. Note that in one embodiment of the present invention, there is no need to achieve all the objects. Other objects are be apparent from and can be derived from the description of the specification, the drawings, the claims, and the like.

In order to reduce the frequency of rewriting pixels, gray scales of image signals input to a plurality of pixels provided in a display portion are checked before displaying each image. Specifically, in the case where image signals having medium gray scale levels are input to many of the plurality of pixels, display is performed by normal driving (for example, driving in which rewriting pixels is performed at a frequency higher than or equal to 60 times per second); otherwise, display is performed by driving with a small number of frequencies of rewriting pixels (for example, driving in which rewriting pixels is performed at a frequency lower than or equal to once per second).

One embodiment of the present invention is a method for driving an information processing device in which image signals are input to a plurality of pixels. The method for driving the information processing device includes the steps of obtaining information of a gray scale of an image signal input to at least one of the plurality of pixels and determining a refresh rate of the plurality of pixels on the basis of the information.

Another embodiment of the present invention is a method for driving an information processing device in which image signals are input to first to A-th pixels (A is a natural number greater than or equal to 2). The method for driving the information processing device includes the steps of counting pixels to which image signal having a gray scale level within a set range are input in the first to B-th pixels (B is a natural number smaller than A); in the case where the number of the counted pixels is greater than or equal to a set pixel number, rewriting the first to A-th pixels at a first refresh rate; and in the case where the sum of the number of the counted pixels and a value (A−B) is smaller than the set pixel number, rewriting the first to A-th pixels at a second refresh rate which is lower than a first refresh rate.

Another embodiment of the present invention is a method for driving an information processing device in which image signals are input to a plurality of pixels. The method for driving the information processing device includes the steps of detecting the proportion of pixels to which image signal having a gray scale level within a set range are input in the plurality of pixels; in the case where the detected proportion is greater than or equal to a set proportion, rewriting the plurality of pixels at a first refresh rate; and in the case where the detected proportion is smaller than the set proportion, rewriting the plurality of pixels at a second refresh rate which is lower than the first refresh rate.

Note that the above pixel may be provided with a liquid crystal element.

The above information processing device can display a still image.

The above first refresh rate can be higher than or equal to 30 Hz, preferably higher than or equal to 60 Hz, for example.

The above second refresh rate can be lower than or equal to 1 Hz, preferably lower than or equal to 0.5 Hz, further preferably lower than or equal to 0.2 Hz, for example.

Another embodiment of the present invention is a program making an information processing device execute the above method for driving the information processing device.

Another embodiment of the present invention is an electronic device which includes the above information processing device and a memory device storing the program.

One embodiment of the present invention can provide an information processing device which can reduce users' eye strain and perform eye-friendly display.

DETAILED DESCRIPTION OF THE INVENTION

Figure 1:
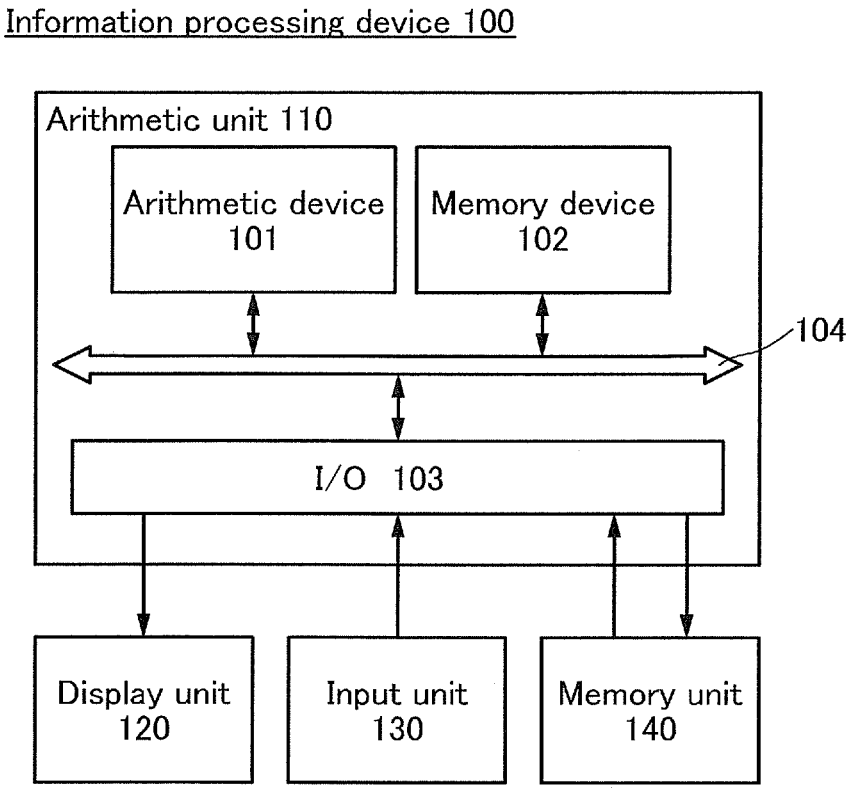
FIG. 1 illustrates a structural example of an information processing device.

Embodiments are described in detail with reference to the drawings. Note that the present invention is not limited to the following description and it is readily appreciated by those skilled in the art that modes and details can be modified in various ways without departing from the spirit and the scope of the present invention. Therefore, the invention should not be construed as being limited to the description in the following embodiments. Note that in structures of the present invention described hereinafter, the same portions or portions having similar functions are denoted by the same reference numerals in different drawings, and description thereof is not repeated.

In this specification, a term "parallel" indicates that the angle formed between two straight lines is greater than or equal to −10° and less than or equal to 10°, and accordingly also includes the case where the angle is greater than or equal to −5° and less than or equal to 5°. In addition, a term "perpendicular" indicates that the angle formed between two straight lines is greater than or equal to 80° and less than or equal to 100°, and accordingly includes the case where the angle is greater than or equal to 85° and less than or equal to 95°.

In this specification, the trigonal and rhombohedral crystal systems are included in the hexagonal crystal system.

Embodiment 1

In this embodiment, a driving method of an information processing device of one embodiment of the present invention is described with reference to FIG. 1, FIG. 2, FIG. 3, and FIG. 4.

FIG. 1 is a block diagram illustrating the structure of the information processing device of one embodiment of the present invention.

Figure 2:
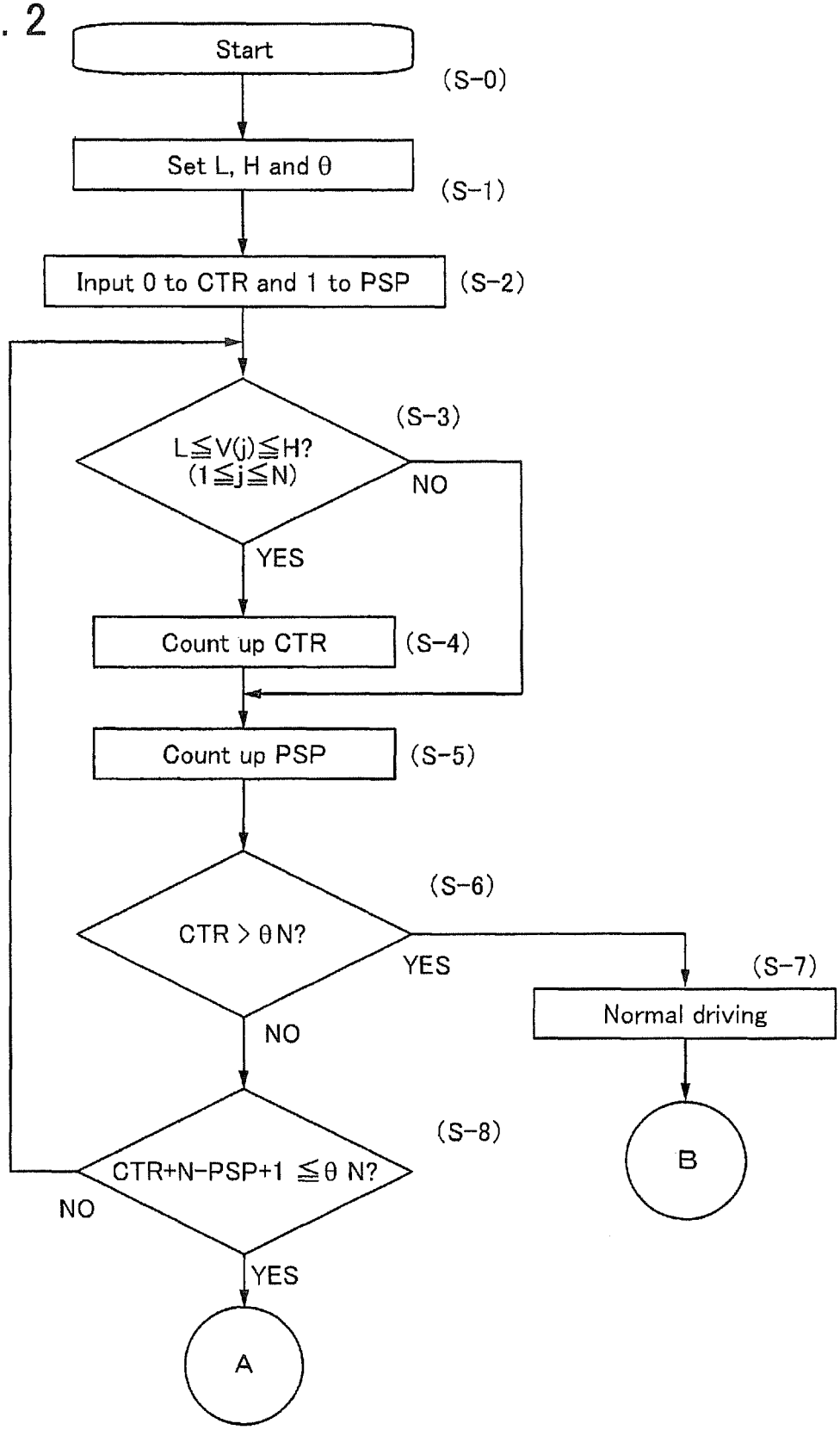
FIG. 2 is a flow chart showing an example of a method for driving an information processing device.
Figure 3:
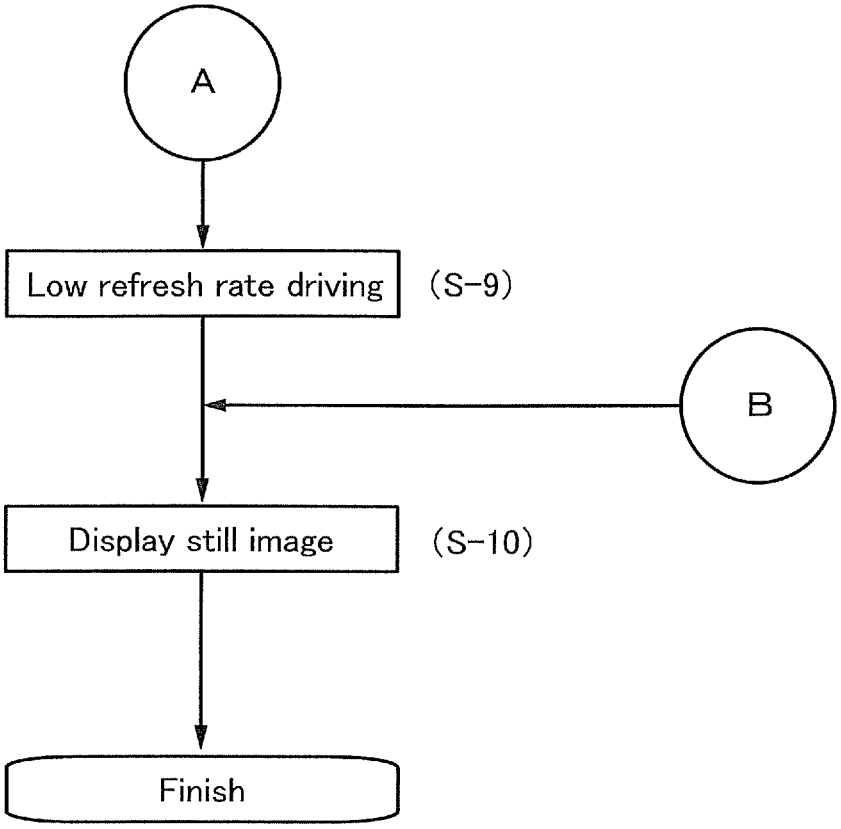
FIG. 3 is a flow chart showing an example of a method for driving an information processing device.
Figure 4:
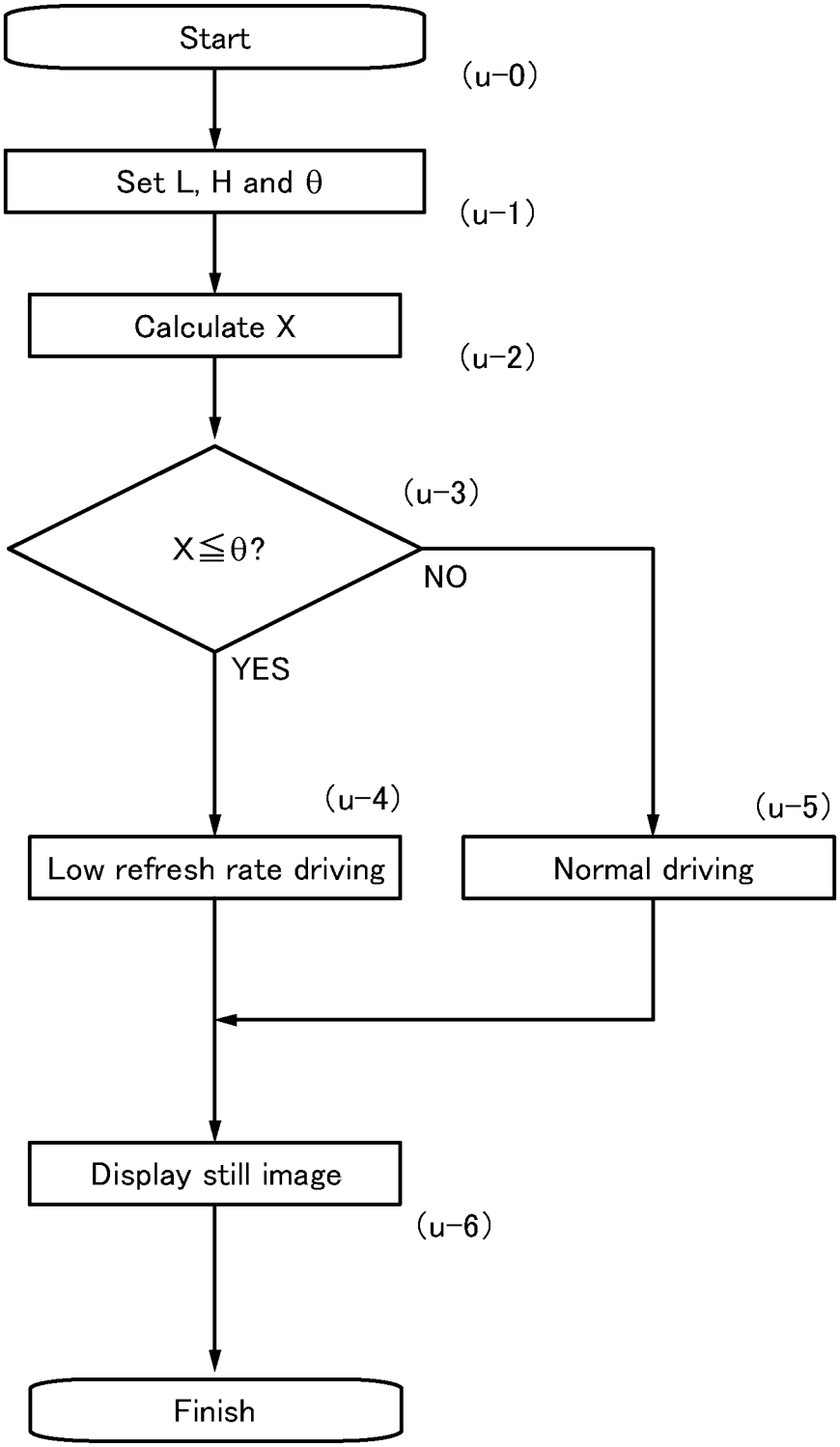
FIG. 4 is a flow chart showing an example of a method for driving an information processing device.

FIG. 2 to FIG. 4 are each a flow chart illustrating an information processing method using an information processing device of one embodiment of the present invention.

FIG. 1 illustrates a structural example of an information processing device 100 described below. An information processing device 100 of one embodiment of the present invention includes an arithmetic unit 110, a display unit 120, an input unit 130, and a memory unit 140.

[Arithmetic Unit]

The arithmetic unit 110 can output an image signal, a synchronization signal such as a vertical synchronization signal or a horizontal synchronization signal, a clock signal, or the like to the display unit 120.

The arithmetic unit 110 includes an arithmetic device 101, a memory device 102, an input/output interface (I/O) 103, and a transmission path 104.

The transmission path 104 connects the arithmetic device 101, the memory device 102, and the I/O 103, and transmits information. The arithmetic unit 110 can transmit and receive information to/from the display unit 120, the input unit 130, and the memory unit 140 through the I/O 103. For example, an input signal from the input unit 130 is input from the I/O 103 and is transmitted to the arithmetic device 101 through the transmission path 104.

The memory device 102 temporarily stores a program executed by the arithmetic device 101 or image data.

The arithmetic device 101 executes a program. For example, in accordance with the executed program, the arithmetic device 101 can analyze an input signal from the input unit 130, read information from the memory unit 140, write information to the memory unit 140, generate a signal and output the signal to the display unit 120, and the like.

[Display Unit]

The display unit 120 includes at least a display portion for displaying an image, and can perform display on the display portion in response to a variety of signals input from the arithmetic unit 110.

The display portion in the display unit 120 includes a plurality of pixels. The pixel density of the pixels arranged in the display portion is preferably higher than or equal to 150 ppi (pixel per inch), further preferably higher than or equal to 200 ppi. Further, it is preferable that light emitted from the display portion do not include light with wavelengths shorter than or equal to 440 nm, preferably shorter than or equal to 420 nm. The display unit 120 which includes such a display portion having a resolution of at least 150 ppi or more and emitting light from which light with wavelengths shorter than or equal to 420 nm is removed can reduce eye strain of users (causes less eye strain). Accordingly, such a display unit can be referred to as a display unit capable of "eye-friendly" display.

[Input Unit]

The input unit 130 converts information which is input by a user into an input signal, and outputs the input signal to the arithmetic unit 110. For the input unit 130, various human interfaces can be used. In addition to a keyboard, a mouse, and a touch panel, for example, a sensor sensing gestures, eye movements, or the like can be used for the input unit 130. Further, a microphone can be used for the input unit 130, and input may be performed by voice recognition.

[Memory Unit]

The memory unit 140 can store a program, image data, and the like. For example, a memory device having higher memory capacity than the memory device 102 is preferably used for the memory unit 140. It is acceptable that the information processing device 100 includes at least one of the memory unit 140 and the memory device 102.

That is the description of the configuration examples of the information processing device 100.

<Driving Method of Information Processing Device>

A driving method of an information processing device of one embodiment of the present invention is described with reference to FIG. 1 and flow charts illustrated in FIG. 2 and FIG. 3.

First, the information processing device 100 starts operation (FIG. 2 (S-0)). At this time, the arithmetic unit 110 executes a program. Further, at this time, the arithmetic unit 110 may read a program from the memory unit 140, and temporarily store the program in the memory device 102 and execute the program.

In the driving method of this embodiment, a range in which an image signal input to a pixel is regarded as an image signal having a medium gray scale level is higher than or equal to L and lower than or equal to H (e.g., in the case of an image signal with 256 gray scales, $50 \leq L \leq 100$ and $150 \leq H \leq 200$). Whether the proportion of pixels to which image signals having medium gray scale levels are input in all of the pixels provided in the display portion (the proportion is referred to the proportion X ($0 \leq X \leq 1$)) is smaller than or equal to a set value θ ($0 < \theta < 1$) is determined. When the X is smaller than or equal to the θ, all of the pixel provided in the display portion are each rewritten at a refresh rate lower than a normal refresh rate (e.g., 60 Hz). The details are described below with reference to FIG. 2. First, the parameters L, H, and θ are set (FIG. 2 (S-1)).

Influence on the alignment of liquid crystal due to a change of a voltage corresponding to an image signal differs between devices. For example, in the case where the voltage corresponding to the $128^{th}$ gray scale level in 256 gray scales is changed by ΔV, influence on the alignment of liquid crystal differs between devices. Thus, the parameters (L, H, and θ) need to be set as appropriate for each device.

For example, the parameters L and H can be incorporated into the program before shipment of final products.

Next, the number of pixels to which image signals having gray scale levels higher than or equal to L and lower than or equal to H are input is calculated. For example, the following method can be used for the calculation. First, a counter in which a value is set 0 is prepared. Next, whether the gray scale level of an image signal input to one of the plurality of pixels provided in the display portion is higher than or equal to L and lower than or equal to H is determined. In the case where the gray scale level is higher than or equal to L and lower than or equal to H, the value of the counter is increased by one. Otherwise, the value of the counter is not changed. Then, the same steps are applied to the rest of the pixels. The method is specifically described with reference to FIG. 2. Note that here, each of the plurality of pixels provided in the display portion is numbered from 1 to N (N is the total number of the pixels provided in the display portion). Then, the following operation is performed on the pixel corresponding to the number input to a pixel selection portion PSP. First, an initial value, 0, is input to a counter CTR. Further, 1 is input to the pixel selection portion PSP (FIG. 2 (S-2)).

Next, it is determined whether the gray scale level V(1) of an image signal input to the pixel which is numbered 1 is higher than or equal to L and lower than or equal to H (FIG. 2 (S-3)). In the case where the gray scale level V(1) of the image signal is higher than or equal to L and lower than or equal to H, the operation proceeds to a fourth step (FIG. 2 (S-4)). In contrast, in the case where the gray scale level V(1) of the image signal is not in the range from L to H, the operation proceeds to a fifth step (FIG. 2 (S-5)).

In the fourth step, the value of the counter CTR is increased by one (FIG. 2 (S-4)).

In the fifth step, the value of the pixel selection portion PSP is increased by one (FIG. 2 (S-5)).

Next, whether the value of the counter CTR is greater than the product (θN) of the set value θ and the total number N of the pixels provided in the display portion is determined (FIG. 2 (S-6)). In the case where the value of the counter CTR is greater than θN (CTR>θN), the operation proceeds to a seventh step (FIG. 2 (S-7)). In contrast, in the case where the value of the counter CTR is smaller than or equal to the θN (CTR≤θN), the operation proceeds to an eighth step (FIG. 2 (S-8)).

The θN is a criterion for determining whether all of the pixels provided in the display portion are rewritten at a normal refresh rate or at a refresh rate lower than the normal refresh rate. Thus, in the driving method of this embodiment, it is not necessary to check all the image signals input to the pixels provided in the display portion. In other words, at the time when the value of the counter CTR is greater than the θN, it is determined to rewrite all of the pixels provided in the display portion at a normal refresh rate. Thus, the above determination does not have to be performed for image signals input to the rest of the pixels.

This enables the processing period to be shortened, and an image to be displayed in a short time. In addition, this can reduce power consumption.

In the seventh step, the refresh rate of all of the pixels on the display portion of the display unit 120 is set to the first refresh rate, and normal driving is performed (FIG. 2 (S-7)).

Here, the first refresh rate is set, for example, higher than or equal to 30 Hz, preferably higher than or equal to 60 Hz.

Next, whether the θN is smaller than or equal to the sum of the value of the counter CTR and the number of the rest of the pixels is determined (FIG. 2 (S-8)). Here, the number of the rest of the pixels is a value obtained by subtracting the value of the pixel selection portion PSP from the total number of the pixels N and adding 1 to the value (N−PSP+1), and the above sum can be represented by (CTR+N−PSP+1). In the case where the θN is smaller than or equal to the value (CTR+N−PSP+1), the operation returns to the third step (FIG. 2 (S-3)). In other words, whether the gray scale V(2) of an image signal input to the pixel which is numbered 2 is higher than or equal to L and lower than or equal to H is determined. In the case where the θN is greater than the value (CTR+N−PSP+1), the operation proceeds to a ninth step.

In the case where the θN is greater than the value (CTR+N−PSP+1) (in the case where θN>CTR+N−PSP+1), even if the gray scale levels of image signals input to the rest of the pixels are all higher than or equal to L and lower than or equal to H is assumed, the number of pixels to which image signals having medium gray scale levels are input is not greater than the θN. Thus, in this case, the above determination does not have to be performed for the rest of the pixels.

This enables the processing period to be shortened, and an image to be displayed in a short time. In addition, this can reduce power consumption.

In the ninth step, the refresh rate of all of the pixels provided in the display portion of the display unit 120 is set to the second refresh rate, and driving with a low refresh rate is performed (FIG. 3 (S-9)).

Here, the second refresh rate is set lower than the first refresh rate which is set in the seventh step. For example, the second refresh rate can be lower than or equal to 1 Hz, preferably lower than or equal to 0.5 Hz, further preferably lower than or equal to 0.2 Hz.

By reducing the refresh rate, display which is eye-friendly for users, which reduces users' eye strain, and which does not give damage to users' eyes can be performed. Further, a displayed image can be refreshed at an appropriate frequency in accordance with the properties of the image displayed on the display portion, and a still image with a small number of flickers can be displayed. In addition, power consumption can be reduced.

Next, a still image is displayed on the display portion of the display unit 120 by each driving method (FIG. 3 (S-10)).

In the driving method of this embodiment, the refresh rate can be changed in accordance with a displayed image. Thus, a clear still image with a small number of flickers can be displayed.

In this manner, an image is displayed.

In this embodiment, the fifth step is performed right before the sixth step, but the present invention is not limited thereto. The fifth step may be performed between the sixth step and the eighth step. The fifth step may be performed between the eighth step and the third step. In the case where the fifth step is performed between the eighth step and the third step, the number of the rest of the pixels in the eighth step is N−PSP.

By repeating the cycles from the third step to the eighth step as described above, images which are displayed by driving with the first refresh rate and images which are displayed by driving with the second refresh rate is used can be distinguished and displayed, so that users' eye strain can be reduced. Thus, by such a driving method, eye-friendly display can be performed.

MODIFICATION EXAMPLE

An example of a driving method part of which is different from the above-described driving method of an information processing device is described below with reference to a flow chart in FIG. 4. Note that portions similar to those described above are not described in some cases.

First, the information processing device 100 starts operation (FIG. 4 (*u*-0)). At this time, the arithmetic unit 110 executes a program. Further, at this time, the arithmetic unit 110 may read a program from the memory unit 140, and temporarily store the program in the memory device 102 and execute the program.

A range in which an image signal input to a pixel is regarded as an image signal having a medium gray scale level is higher than or equal to L and lower than or equal to H, and whether the proportion of pixels to which image signals having medium gray scale levels are input in all of the pixels provided in the display portion (the proportion is referred to the proportion X (0≤X≤1)) is smaller than or equal to a set value θ is determined. When the X is smaller than or equal to the θ, all of the pixel provided in the display portion are each rewritten at a refresh rate lower than a normal refresh rate (e.g., 60 Hz). The details are described below with reference to FIG. 4. First, the parameters L, H, and θ are set (FIG. 4 (*u*-1)).

For the first step, the above-described step (S-1) can be referred to.

Next, the proportion X is calculated using information processed in the information processing device. The proportion X can be obtained from the formula below (FIG. 4 (*u*-2)).

[FORMULA 1]

$$X = \frac{\sum_{i=L}^{H} N(i)}{N}$$

Here, N indicates the total number of pixels of the image, and N(i) indicates the number of pixels to which image signals having the i-th gray scale level are input.

Next, whether the obtained proportion X is smaller than or equal to the set value θ (X≤θ) is determined (FIG. 4 (*u*-3)). In the case where the proportion X is smaller than or equal to the set value θ (X≤θ), the operation proceeds to a fourth step (FIG. 4 (*u*-4)). In contrast, in the case where the proportion X is not smaller than or equal to the set value θ (X≤θ), in other words, in the case where the proportion X is greater than the set value θ (X>θ), the operation proceeds to a fifth step (FIG. 4 (*u*-5)).

In the fourth step, the refresh rate of all of the pixels provided in the display portion of the display unit 120 is set to the third refresh rate, and the driving with a low refresh rate is performed (FIG. 4 (*u*-4)).

Here, the third refresh rate is set lower than a fourth refresh rate which is set in the fifth step. For example, the third refresh rate can be lower than or equal to 1 Hz, preferably lower than or equal to 0.5 Hz, further preferably lower than or equal to 0.2 Hz.

By reducing the refresh rate, display which is eye-friendly for users, which reduces users' eye strain, and which does not give damage to users' eyes can be performed. Further, a displayed image can be refreshed at an appropriate frequency in accordance with the properties of the image displayed on the display portion, and a still image with a small number of flickers can be displayed. In addition, power consumption can be reduced.

In the fifth step, the refresh rate of all of the pixels provided in the display portion of the display unit 120 is set to the fourth refresh rate, and normal driving is performed (FIG. 4 (*u*-5)).

Here, the fourth refresh rate is set, for example, higher than or equal to 30 Hz, preferably higher than or equal to 60 Hz.

Next, a still image is displayed on the display portion of the display unit 120 by each driving method (FIG. 4 (*u*-6)).

Similarly to the driving method in FIG. 2, the driving method in FIG. 4 can change the refresh rate in accordance with a displayed image. Thus, a clear still image with a small number of flickers can be displayed.

In this manner, an image is displayed.

As described above, images which are displayed by driving with the third refresh rate and images which are displayed by driving with the fourth refresh rate can be distinguished and displayed, so that users' eye strain can be reduced. Thus, by such a driving method, eye-friendly display can be performed.

The above-described driving methods can also be applied to an information processing device displaying a color image. Pixels provided in a display portion of the information processing device displaying a color image generally include sub-pixels of at least red (R), green (G), and blue (B). Image signals are input to each of the sub-pixels. Thus, by utilizing the image signals input to the sub-pixels, the above-described driving methods can be applied to the information processing device displaying a color image.

For example, a pixel is divided into three sub-pixels (RGB components), and similarly to the above-described first step, a range in which an input image signal is regarded as an image signal having a medium gray scale level is set for each of the RGB components. Here, the range in which an image signal input to the R component is regarded as an image signal having a medium gray scale level is set higher than or equal to $L_R$ and lower than or equal to $H_R$. The range in which an image signal input to the G component is regarded as an image signal having a medium gray scale level is set higher than or equal to $L_G$ and lower than or equal to $H_G$. The range in which an image signal input to the B component is regarded as an image signal having a medium gray scale level is set higher than or equal to $L_B$ and lower than or equal to $H_B$.

Next, similarly to the above-described second step, the proportions $X_R$, $X_G$, and $X_B$ of the sub-pixels to which image signals having medium gray scale levels are input are calculated.

Next, similarly to the above-described third step, whether the obtained proportion $X_R$ of the sub-pixels to which image signals having medium gray scale levels are input is smaller than or equal to the set value $\theta_R$ ($X_R \leq \theta_R$) is determined. Further, whether the obtained proportion $X_G$ of the sub-pixels to which image signals having medium gray scale levels are input is smaller than or equal to the set value $\theta_G$ ($X_G \leq \theta_G$) is determined. Further, whether the obtained proportion $X_B$ of the sub-pixels to which image signals having medium gray scale levels are input is smaller than or equal to the set value $\theta_B$ ($X_B \leq \theta_B$) is determined.

In the determination, in the case where the proportion of the sub-pixels to which image signals having medium gray scale levels are input is smaller than or equal to the set value in each of the color components, the refresh rate of display on the display portion of the display unit 120 is set to the third refresh rate, and the driving with a low refresh rate is performed.

In the determination, in the case where the proportion of the sub-pixels to which image signals having medium gray scale levels are input is greater than the set value in at least one of the color components, the refresh rate of display on the display portion of the display unit 120 is set to the fourth refresh rate, and normal driving is performed.

As described above, images which are displayed by driving with the third refresh rate and images which are displayed by driving with the fourth refresh rate can be distinguished and displayed, so that users' eye strain can be reduced. Thus, by such a driving method, eye-friendly display can be performed.

Note that in this embodiment, examples in which the driving with a low refresh rate or normal driving is performed in accordance with a displayed image is described; however, one embodiment of the present invention is not limited thereto. In one embodiment of the present invention, regardless of a displayed image, the driving with a low refresh rate may be performed as appropriate in accordance with circumstances. Similarly, in one embodiment of the present invention, regardless of a displayed image, normal driving may be performed as appropriate in accordance with circumstances.

<Eye Strain>

Eye strain (eye fatigue) of users is divided into two categories: nervous strain and muscular strain.

Nervous strain is caused by keeping looking at lighting or flashing for a long time because a retina, a nerve, or a brain is stimulated by the light. A stimulus to a nerve or a brain might adversely affect the circadian rhythm.

Muscular strain is caused by heavy use of a ciliary muscle, which is used for focusing the eye on an object (adjusting focus). It is known that the closest distance at which an eye is focused on an object is lengthened owing to muscular strain.

Figure 5A:
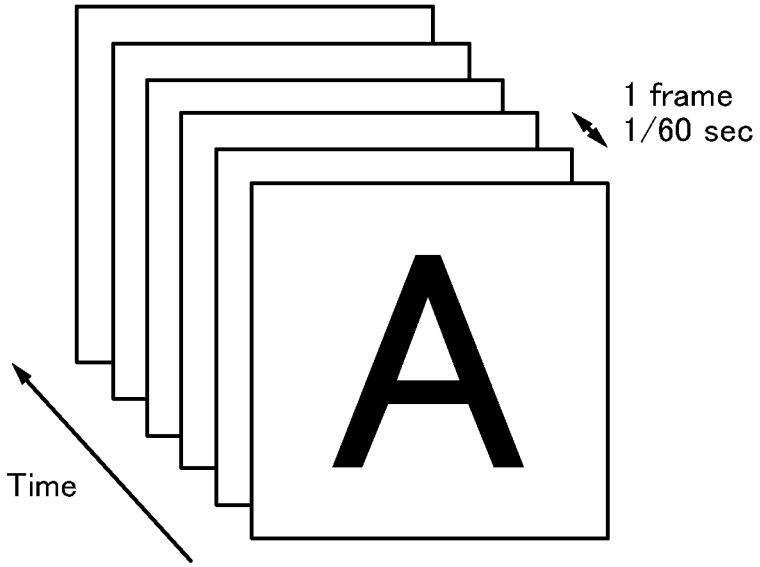
FIGS. 5A and 5B each illustrate an example of display on a display portion.

FIG. 5A is a schematic diagram illustrating display of a conventional display portion. As illustrated in FIG. 5A, for the display of the conventional display portion, image rewriting is performed 60 times per second (60 Hz). A prolonged looking at such a screen might stimulate a retina, an optic nerve, and a brain of a user and lead to eye strain.

In one embodiment of the present invention, a transistor including an oxide semiconductor (e.g., a transistor including a c-axis aligned crystalline oxide semiconductor (CAAC-OS)) can be used in a pixel portion of a display portion as described in an embodiment below. Since the transistor including an oxide semiconductor has an extremely small off-state current, the luminance of the display portion can be kept even when the frame frequency is decreased.

Figure 5B:
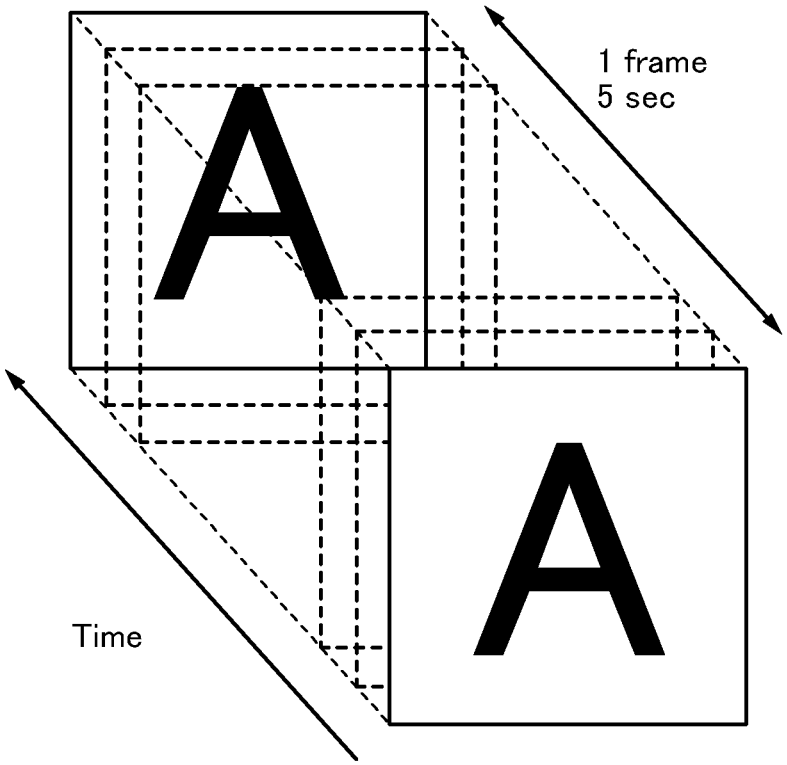

Thus, for example, the number of times of image writing can be reduced to once per five seconds (0.2 Hz) as shown in FIG. 5B. The same image can be displayed for a long time as much as possible and flickers on a screen perceived by a user can be reduced. Therefore, stimuli to a retina, an optic nerve, and a brain of a user are reduced, so that the strain is reduced.

Figure 6A:
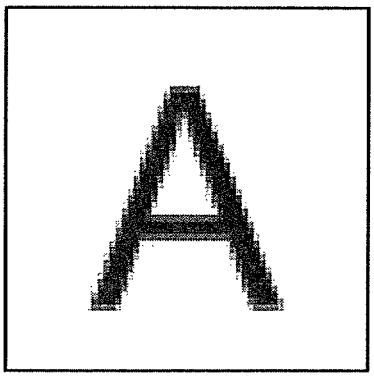
FIGS. 6A and 6B each illustrate an example of display on a display portion.

In the case where the size of one pixel is large (e.g., the resolution is less than 150 ppi), a bluffed character is displayed by a display portion as shown in FIG. 6A. When a user looks at the blurred character displayed on the display portion for a long time, their ciliary muscles keep working to adjust the focus in a state where adjusting the focus is difficult, which might lead to eye strain.

Figure 6B:
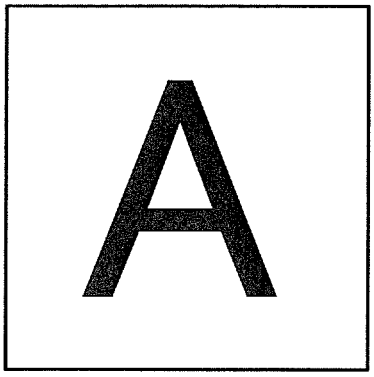

In contrast, in the display portion of one embodiment of the present invention, the size of one pixel is small and thus high resolution display is performed as shown in FIG. 6B, so that precise and smooth display can be achieved. The precise and smooth display enables ciliary muscles to adjust the focus more easily, and reduces muscular strain of users. In the case where the pixel density of the display portion is higher than or equal to 150 ppi, preferably higher than or equal to 200 ppi, users' muscular strain can be effectively reduced.

Quantitative measurement of eye strain has been studied. For example, a critical flicker (fusion) frequency (CFF) is known as an index of measuring nervous strain; and accommodation time and an accommodation near point are known as indexes of measuring muscular strain.

Examples of other methods for measuring eye strain include electroencephalography, thermography, measurement of the number of blinkings, measurement of tear volume, measurement of a pupil contractile response speed, and a questionnaire for surveying subjective symptoms.

The above-described various methods prove that eye strain can be reduced and eye-friendly display can be obtained in the case of using the driving method of an information processing device which is one embodiment of the present invention as compared to the case of using a conventional driving method.

This embodiment can be combined with any of the other embodiments disclosed in this specification as appropriate.

Embodiment 2

In this embodiment, an example of the information processing device described in Embodiment 1 is described with reference to FIG. 7 and FIGS. 8A and 8B.

Specifically, an information processing device including a first mode and a second mode is described. In the first mode, G signals for selecting pixels are output at a frequency higher than or equal to 30 Hz (30 times per second), preferably higher than or equal to 60 Hz (60 times per second) and lower than or equal to 960 Hz (960 times per second). In the second mode, G signals for selecting pixels are output at a frequency lower than or equal to 1 Hz, higher than or equal to $1.16\times10^{-5}$ Hz (about once per day) and lower than or equal to 1 Hz, higher than or equal to $2.78\times10^{-4}$ Hz (about once per hour) and lower than or equal to 0.5 Hz, or higher than or equal to $1.67\times10^{-2}$ Hz (about once per minute) and lower than or equal to 0.1 Hz.

Figure 7:
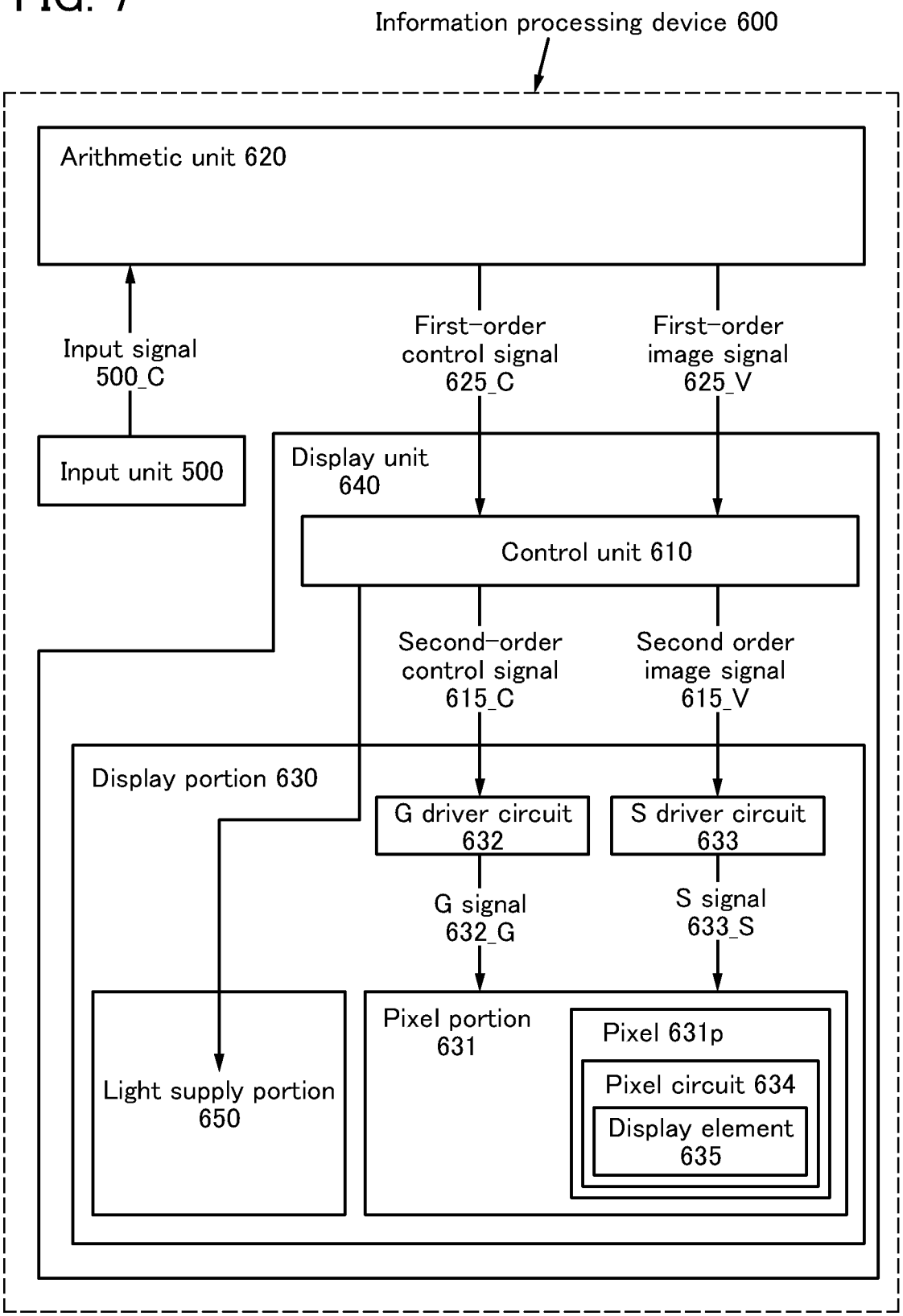
FIG. 7 illustrates a structural example of an information processing device.

FIG. 7 is a block diagram of a structure of an information processing device having a display function of one embodiment of the present invention.

Figure 8A:
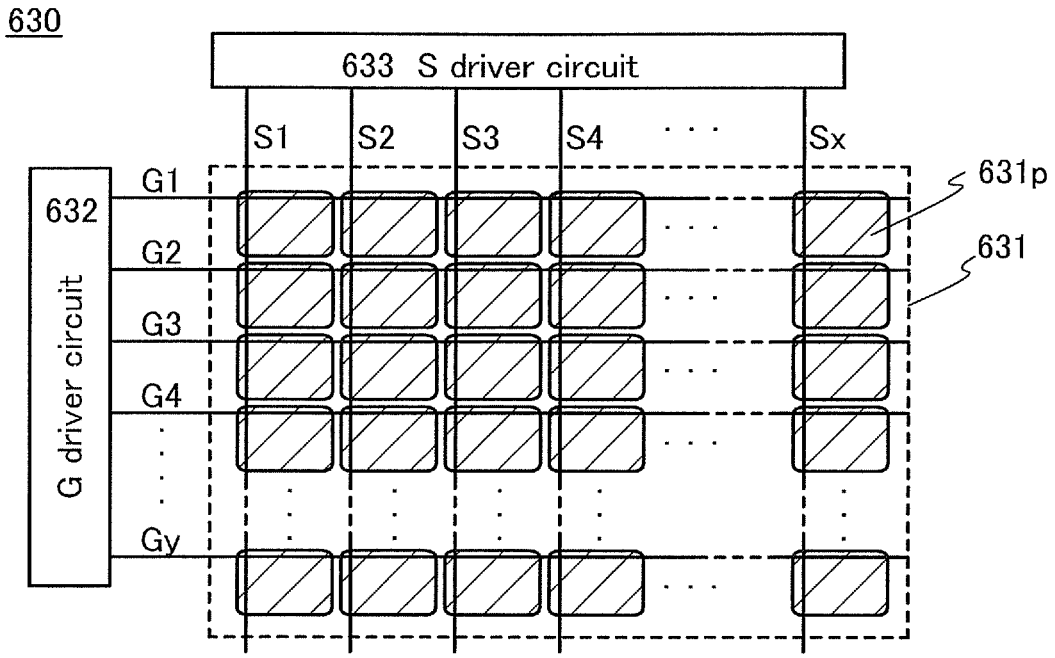
FIGS. 8A and 8B illustrate a structural example of a display portion of an information processing device.
Figure 8B:
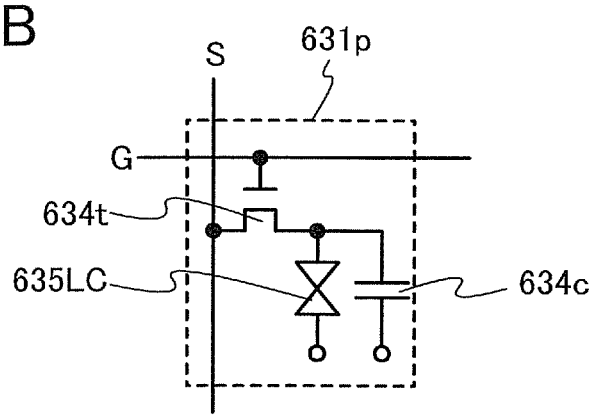

FIGS. 8A and 8B are a block diagram and a circuit diagram illustrating a structure of a display portion in the information processing device having a display function of one embodiment of the present invention.

<1. Structure of Information Processing Device>

An information processing device 600 having a display function which is described in this embodiment with reference to FIG. 7 includes a pixel portion 631, pixel circuits 634 which hold first driving signals (also referred to as S signals) 633_S which are input and include display elements 635 displaying an image in the pixel portion 631 in accordance with the S signals 633_S, a first driver circuit (also referred to as S driver circuit) 633 which outputs the S signals 633_S to the pixel circuits 634, and a second driver circuit (also referred to as G driver circuit) 632 which outputs second driving signals (also referred to as G signals) 632_G for selecting the pixel circuits 634 to the pixel circuits 634.

The G driver circuit 632 has a first mode in which the G signals 632_G are output to the pixels at a frequency higher than or equal to 30 times per second, preferably higher than or equal to 60 times per second and lower than or equal to 960 times per second, and a second mode in which the G signals 632_G are output to the pixels at a frequency lower than or equal to once per second, preferably higher than or equal to once per day and lower than or equal to once per second, further preferably higher than or equal to once per hour and lower than or equal to once per second.

Note that the G driver circuit 632 is switched between the first mode and the second mode in response to a mode switching signal(s) which is/are input.

The pixel circuit 634 is provided in a pixel 631*p*. A plurality of pixels 631*p* are provided in the pixel portion 631 in the display portion 630.

The information processing device 600 having a display function includes an arithmetic unit 620. The arithmetic unit 620 outputs first-order control signals 625_C and first-order image signals 625_V.

A display unit 640 includes the display portion 630 and a control unit 610. The control unit 610 controls the S driver circuit 633 and the G driver circuit 632.

In the case where a liquid crystal element is used as the display element 635, the display portion 630 is provided with a light supply portion 650. The light supply portion 650 supplies light to the pixel portion 631 including liquid crystal elements and serves as a backlight.

In the information processing device 600 having a display function, the frequency of selecting one pixel circuit from the plurality of pixel circuits 634 in the pixel portion 631 can be changed by the G signals 632_G output from the G driver circuit 632. Consequently, an information processing device with a display function which is less likely to cause eye strain of users can be provided as the information processing device 600.

Although the block diagram attached to this specification shows components classified by their functions in independent blocks, it is difficult to classify actual components according to their functions completely and it is possible for one component to have a plurality of functions.

In this specification, the terms "source" and "drain" of a transistor interchange with each other depending on the polarity of the transistor or the levels of potentials applied to the terminals. In general, in an n-channel transistor, a terminal to which a lower potential is applied is called a source, and a terminal to which a higher potential is applied is called a drain. Further, in a p-channel transistor, a terminal to which a lower potential is applied is called a drain, and a terminal to which a higher potential is applied is called a source. In this specification, although connection relation of the transistor is described assuming that the source and the drain are fixed in some cases for convenience, actually, the names of the source and the drain interchange with each other depending on the relation of the potentials.

Note that in this specification, a "source" of a transistor means a source region that is part of a semiconductor film functioning as an active layer or a source electrode connected to the semiconductor film. Similarly, a "drain" of the transistor means a drain region that is part of the semiconductor film or a drain electrode connected to the semiconductor film. A "gate" means a gate electrode.

Note that in this specification, a state in which transistors are connected to each other in series means, for example, a state in which only one of a source and a drain of a first transistor is connected to only one of a source and a drain of a second transistor. In addition, a state in which transistors are connected to each other in parallel means a state in which one of a source and a drain of a first transistor is connected to one of a source and a drain of a second transistor and the other of the source and the drain of the first transistor is connected to the other of the source and the drain of the second transistor.

In this specification, the term "connection" means electrical connection and corresponds to a state where current, voltage, or a potential can be supplied or transmitted. Accordingly, a connection state means not only a state of direct connection but also a state of indirect connection through a circuit element such as a wiring, a resistor, a diode, or a transistor so that current, voltage, or a potential can be supplied or transmitted.

In this specification, even when different components are connected to each other in a circuit diagram, there is actually a case where one conductive film has functions of a plurality of components such as a case where part of a wiring serves as an electrode. The term "connection" also means such a case where one conductive film has functions of a plurality of components.

Elements included in the information processing device having a display function of one embodiment of the present invention are described below.

<2. Arithmetic Unit>

The arithmetic unit 620 generates the first-order image signal 625_V and the first-order control signal 625_C.

The arithmetic unit 620 generates the first-order control signal 625_C including the mode-switching signal.

For example, the arithmetic unit 620 may output the first-order control signal 625_C including the mode-switching signal in accordance with an input signal 500_C output from an input unit 500.

When the input signal 500_C is input to the G driver circuit 632 in the second mode from the input unit 500 through the control unit 610, the G driver circuit 632 switches its mode from the second mode to the first mode, and outputs a G signal at least once, and then switches its modes to the second mode.

For example, when the input unit 500 senses operation of moving an image, the input unit 500 outputs the input signal 500_C to the arithmetic unit 620.

The arithmetic unit 620 generates the first-order image signal 625_V including the image moving operation and outputs the first-order image signal 625_V together with the first-order control signal 625_C including the input signal 500_C.

The control unit 610 outputs the second-order control signal 615_C to the G driver circuit 632 and outputs the second-order image signal 615_V including the image moving operation to the S driver circuit 633.

The G driver circuit 632 switches its modes from the second mode to the first mode, and rewrites the G signal 632_G at a rate at which viewers cannot perceive a change in image occurring each time a signal is rewritten.

Meanwhile, the S driver circuit 633 outputs to the pixel circuits 634 the S signals 633_S generated from the second-order image signal 615_V including the image moving operation.

Thus, the pixel 631*p* can display many frame images including the image moving operation for a short time, whereby the second-order image signal 615_V which can perform smooth image moving operation can be output.

Alternatively, a structure can be employed in which when the second mode is switched to the first mode, the G signal 632_G is output a predetermined number of times which is larger than or equal to one, and then the first mode is switched to the second mode.

<3. Control Unit>

The control unit 610 outputs the second-order image signal 615_V generated from the first-order image signal 625_V (see FIG. 7). Note that the first-order image signal 625_V may be directly input to the display portion 630.

The control unit 610 has a function of generating a second-order control signal 615_C (e.g., a start pulse signal SP, a latch signal LP, or a pulse width control signal PWC) from the first-order control signal 625_C including a synchronization signal (e.g., a vertical synchronization signal or a horizontal synchronization signal) and supplying the generated signal to the display portion 630. Note that the second-order control signal 615_C includes a clock signal CK or the like.

The control unit 610 may be provided with an inversion control circuit to have a function of inverting the polarity of the second-order image signal 615_V at a timing notified by the inversion control circuit. Specifically, the inversion of the polarity of the second-order image signal 615_V may be performed in the control unit 610 or in the display portion 630 in accordance with an instruction by the control unit 610.

The inversion control circuit has a function of determining timing of inverting the polarity of the second-order image signal 615_V by using a synchronization signal. For example, the inversion control circuit includes a counter and a signal generation circuit.

The counter has a function of counting frame periods by using the pulse of a horizontal synchronization signal.

The signal generation circuit has a function of notifying timing of inverting the polarity of the second-order image signal 615_V to the control unit 610 so that the polarity of the second-order image signal 615_V is inverted every plural consecutive frame periods by using information on the number of frame periods that is obtained in the counter.

<4. Display Portion>

The display portion 630 includes the pixel portion 631 including a display element 635 in each pixel and driver circuits such as the S driver circuit 633 and the G driver circuit 632. The pixel portion 631 includes a plurality of pixels 631*p* each provided with the display element 635 (see FIG. 7).

The second-order image signal 615_V that are input to the display portion 630 are supplied to the S driver circuit 633. In addition, power supply potentials and the second-order control signal 615_C are supplied to the S driver circuit 633 and the G driver circuit 632.

Note that the second-order control signals 615_C include an S driver circuit start pulse signal SP, an S driver circuit clock signal CK, and a latch signal LP that control the operation of the S driver circuit 633; a G driver circuit start pulse SP, a G driver circuit clock signal CK, and a pulse width control signal PWC that control the operation of the G driver circuit 632; and the like.

FIG. 8A illustrates an example of a structure of the display portion 630.

In the display portion 630 in FIG. 8A, the plurality of pixels 631*p*, a plurality of scan lines G for selecting the pixels 631*p* row by row, and a plurality of signal lines S for supplying the S signals 633_S generated from the second-order image signal 615_V to the selected pixels 631*p* are provided in the pixel portion 631.

The input of the G signals 632_G to the scan lines G is controlled by the G driver circuit 632. The input of the S signals 633_S to the signal lines S is controlled by the S driver circuit 633. Each of the plurality of pixels 631*p* is connected to at least one of the scan lines G and at least one of the signal lines S.

Note that the kinds and number of the wirings in the pixel portion 631 can be determined by the structure, number, and position of the pixels 631*p*. Specifically, in the pixel portion 631 illustrated in FIG. 8A, the pixels 631*p* are arranged in a matrix of x columns and y rows, and the signal lines S1 to Sx and the scan lines G1 to Gy are provided in the pixel portion 631.

<4-1. Pixel>

Each pixel 631*p* includes the pixel circuit 634 including the display element 635.

<4-2. Pixel Circuit>

In this embodiment, as an example of the pixel circuit 634, a structure in which a liquid crystal element 635LC is used as the display element 635 is illustrated in FIG. 8B.

The pixel circuit 634 includes a transistor 634*t* for controlling supply of the S signal 633_S to the liquid crystal element 635LC. An example of connection relation between the transistor 634*t* and the display element 635 is described.

A gate of the transistor 634*t* is connected to any one of the scan lines G1 to Gy. One of a source and a drain of the transistor 634*t* is connected to any one of the signal lines S1 to Sx. The other of the source and the drain of the transistor 634*t* is connected to a first electrode of the display element 635.

Note that pixel 631*p* may include, in addition to the capacitor 634*c* for holding voltage between a first electrode and a second electrode of the liquid crystal element 635LC, another circuit element such as a transistor, a diode, a resistor, a capacitor, or an inductor as needed.

In the pixel 631*p* illustrated in FIG. 8B, one transistor 634*t* is used as a switching element for controlling input of the S signal 633_S to the pixel 631*p*. However, a plurality of transistors which serve as one switching element may be used in the pixel 631*p*. In the case where the plurality of transistors serve as one switching element, the transistors may be connected to one another in parallel, in series, or in combination of parallel connection and series connection.

Note that the size of the capacitor 634*c* may be adjusted as appropriate. For example, in the second mode to be described later, in the case where the S signal 633_S is held for a relatively long time (specifically, longer than or equal to 1/60 sec), the capacitor 634*c* is provided. Alternatively, the capacitance of the pixel circuit 634 may be adjusted by utilizing a structure other than the capacitor 634*c*. For example, with a structure in which the first electrode and the second electrode of the liquid crystal element 635LC are formed to overlap with each other, a capacitor may be substantially formed.

Note that the structure of the pixel circuit 634 can be selected depending on the kind of the display element 635 or the driving method.

<4-2a. Display Element>

The liquid crystal element 635LC includes a first electrode, a second electrode, and a liquid crystal layer including a liquid crystal material to which the voltage between the first electrode and the second electrode is applied. In the liquid crystal element 635LC, the alignment of liquid crystal molecules is changed in accordance with the level of voltage applied between the first electrode and the second electrode, so that the transmittance of the pixel 631*p* is changed. Accordingly, the transmittance of the pixel 631*p* is controlled by the potential of the S signal 633_S; thus, gradation can be expressed.

Note that, besides the liquid crystal element 635LC, any of a variety of display elements such as an OLED element generating luminescence (electroluminescence) when an electric field is applied thereto and electronic ink utilizing electrophoresis can be used as the display element 635.

<4-2b. Transistor>

The transistor 634*t* controls whether to apply the potential of the signal line S to the first electrode of the display element 635. A predetermined reference potential Vcom is applied to the second electrode of the display element 635.

Note that a transistor including an oxide semiconductor can be suitably used for the information processing device having a display function to which the driving method of an information processing device having a display function of one embodiment of the present invention can be applied. Embodiment 6 can be referred to for details of the transistor including an oxide semiconductor.

<5. Light Supply Portion>

A plurality of light sources are provided in the light supply portion 650. The control unit 610 controls driving of the light sources in the light supply portion 650.

The light source in the light supply portion 650 can be a cold cathode fluorescent lamp, a light-emitting diode (LED), an OLED element generating luminescence when an electric field is applied thereto, or the like.

In particular, the intensity of blue light emitted by the light source is preferably weakened compared to that of light of any other color. Blue light included in light emitted by the light source reaches the retina of the eye without being absorbed by the cornea or the lens. Accordingly, when the intensity of blue light emitted by the light source is weaken as compared to that of light of any other color, it is possible to reduce long-term effects of blue light on the retina (e.g., age-related macular degeneration), adverse effects of exposure to blue light until midnight on the circadian rhythm, and the like. In addition, a light source emitting light that mainly includes light with a wavelength longer than 400 nm and does not include light with a wavelength shorter than or equal to 400 nm (also referred to as UVA) is preferred. In addition, a light source emitting light that mainly includes light with a wavelength longer than 440 nm and does not include light with a wavelength shorter than or equal to 440 nm, further preferably a light source emitting light that mainly includes light with a wavelength longer than 420 nm and does not include light with a wavelength shorter than or equal to 420 nm, can be used.

Figure 23:
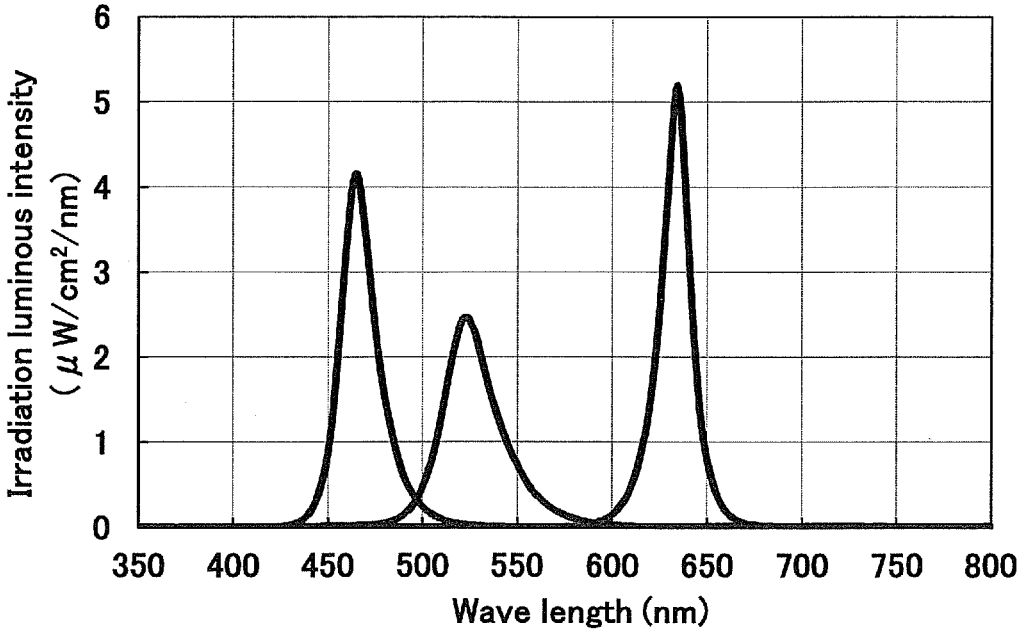
FIG. 23 illustrates an example of emission spectra of a backlight.

FIG. 23 shows emission spectra of a preferable backlight. As light sources of the backlight, light emitting diodes (LEDs) of three colors, R (red), G (green), and B (blue), are used. FIG. 23 shows emission spectra of the LEDs. In FIG. 23, irradiation luminous intensity is hardly observed at a wavelength of 420 nm or shorter. A display portion with the backlight for which these light sources are used can reduce eye strain of Users.

<6. Input Unit>

As the input unit 500, various human interfaces such as a touch panel, a touch pad, a mouse, a keyboard, a finger joystick, a trackball, a data glove, and an imaging device can be used. The arithmetic unit 620 can select the refresh rate at the first mode or the refresh rate at the second mode on the basis of an electric signal input from the input unit 500, so that a mode having an appropriate refresh rate can be selected. Accordingly, users can input an instruction for processing information displayed on the display portion.

Examples of information input with the input unit 500 by users are instructions for dragging an image displayed on the display portion to another position on the display portion; for swiping a screen for turning a displayed image and displaying the next image; for scrolling a continuous image; for selecting a specific image; for pinching a screen for changing the size of a displayed image; and for inputting handwritten characters.

The information processing device described in this embodiment can reduce users' eye strain and perform eye-friendly display by employing the driving method of an information processing device described in Embodiment 1 and making the arithmetic unit execute a program for driving the information processing device as described in Embodiment 1.

This embodiment can be combined with any of the other embodiments disclosed in this specification as appropriate.

Embodiment 3

In this embodiment, an example of a method for driving the information processing device described in Embodiment 2 is described with reference to FIGS. 8A and 8B, FIG. 9, and FIG. 10.

Specifically, a driving method of an information processing device including a first mode and a second mode is described. In the first mode, G signals for selecting pixels are output at a frequency higher than or equal to 30 Hz (30 times per second), preferably higher than or equal to 60 Hz (60 times per second) and lower than or equal to 960 Hz (960 times per second). In the second mode, G signals for selecting pixels are output at a frequency lower than or equal to 1 Hz, higher than or equal to $1.16\times10^{-5}$ Hz (about once per day) and lower than or equal to 1 Hz, higher than or equal to $2.78\times10^{-4}$ Hz (about once per hour) and lower than or equal to 0.5 Hz, or higher than or equal to $1.67\times10^{-2}$ Hz (about once per minute) and lower than or equal to 0.1 Hz.

FIGS. 8A and 8B are a block diagram and a circuit diagram illustrating an example of a configuration of a display portion which can be applied to a display unit of an information processing device having a display function of one embodiment of the present invention.

Figure 9:
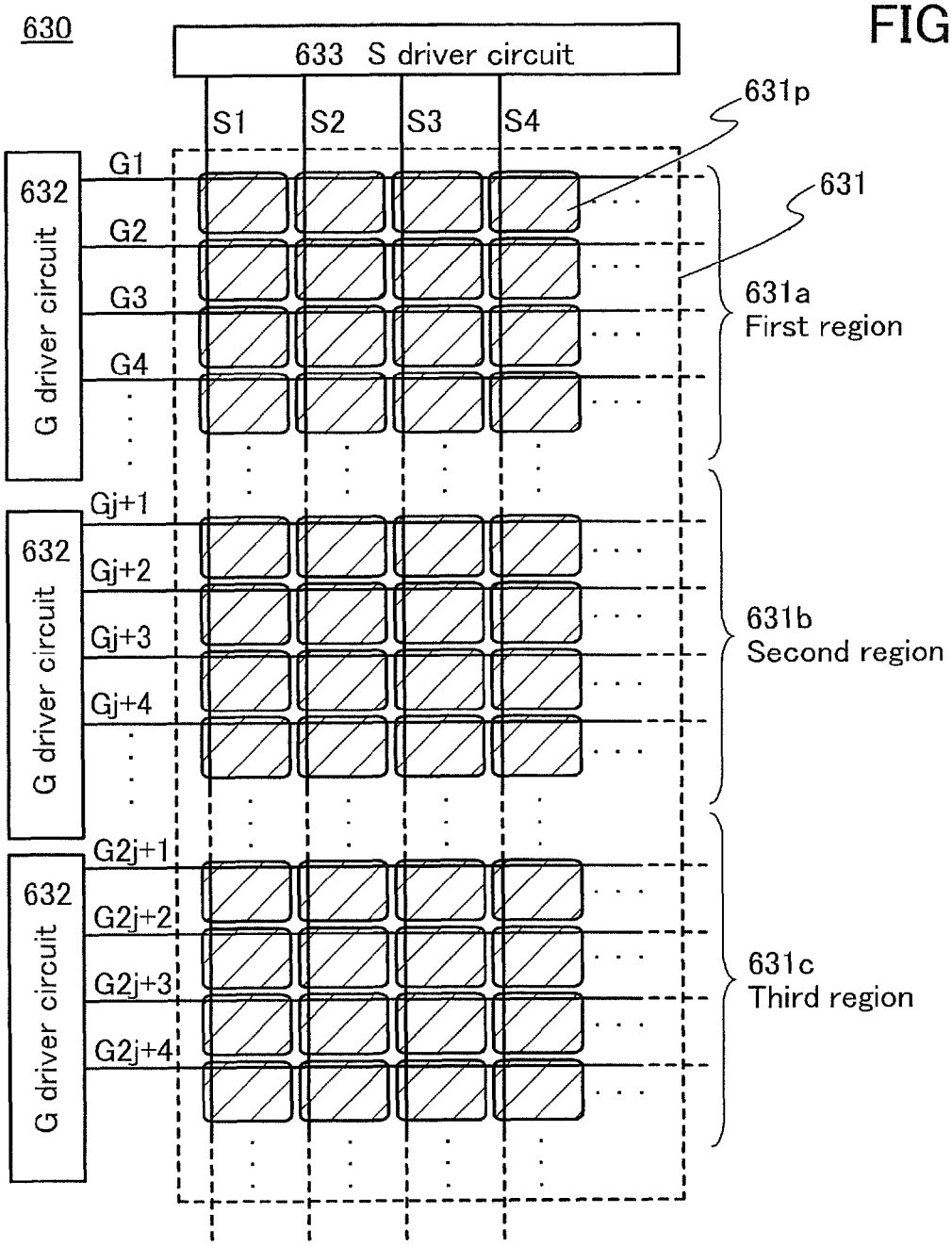
FIG. 9 illustrates a structural example of a display portion of an information processing device.

FIG. 9 is a block diagram illustrating a modification example of a display portion which can be applied to a display unit of an information processing device having a display function of one embodiment of the present invention.

Figure 10:
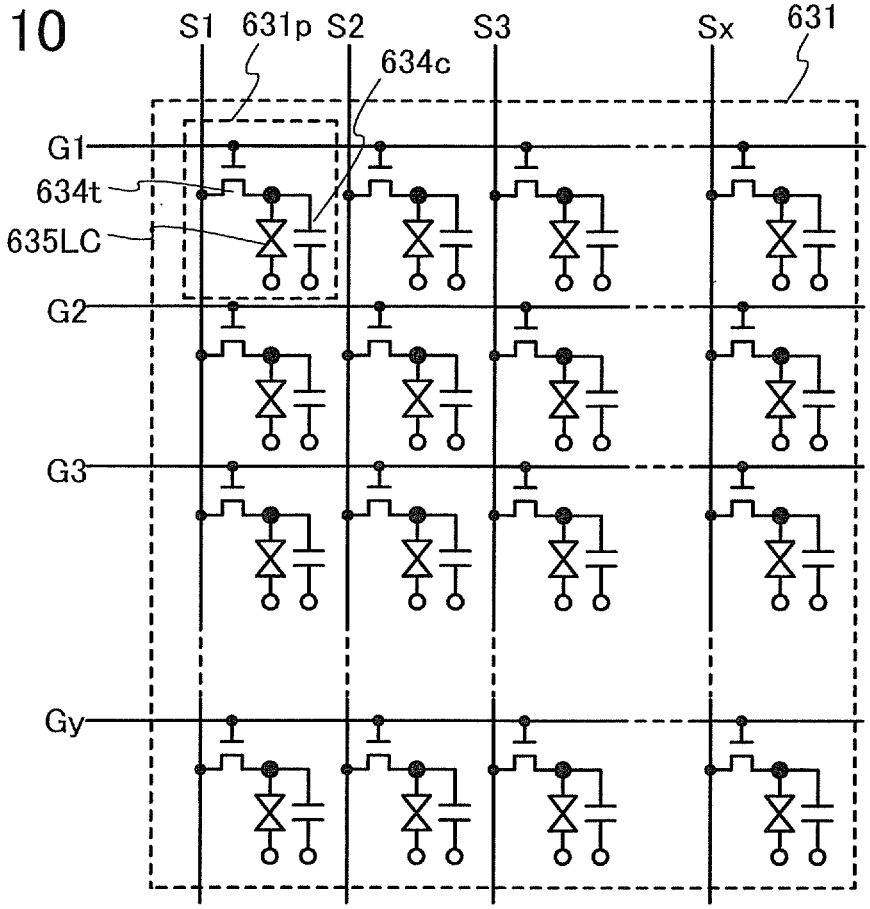
FIG. 10 illustrates a structural example of an information processing device.

FIG. 10 is a circuit diagram illustrating an example of a configuration of a display portion which can be applied to a display unit of an information processing device having a display function of one embodiment of the present invention.

<1. Method for Writing S Signals into Pixel Portion>

An example of a method for writing the S signals 633_S into the pixel portion 631 in FIG. 8A or FIG. 9 is described. Specifically, the method described here is a method for writing the S signal 633_S into each pixel 631*p* including the pixel circuit illustrated in FIG. 8B in the pixel portion 631.

<Writing Signals into Pixel Portion>

In a first frame period, the scan line G1 is selected by input of the G signal 632_G with a pulse to the scan line G1. In each of the plurality of pixels 631*p* connected to the selected scan line G1, the transistor 634*t* is turned on.

When the transistors 634*t* are on (in one line period), the potentials of the S signals 633_S generated from the second-order image signals 615_V are applied to the signal lines S1 to Sx. Through each of the transistors 634*t* that are on, charge corresponding to the potential of the S signal 633_S is accumulated in the capacitor 634*c* and the potential of the S signal 633_S is applied to a first electrode of the liquid crystal element 635LC.

In a period during which the scan line G1 is selected in the first frame period, the S signals 633_S having a positive polarity are sequentially input to all the signal lines S1 to Sx. Thus, the S signals 633_S having a positive polarity are input to first electrodes G1S1 to G1Sx in the pixels 631*p* that are connected to the scan line G1 and the signal lines S1 to Sx. Accordingly, the transmittance of the liquid crystal element 635LC is controlled by the potential of the S signal 633_S; thus, gradation is expressed by the pixels.

Similarly, the scan lines G2 to Gy are sequentially selected, and the pixels 631*p* connected to the scan lines G2 to Gy are sequentially subjected to the same operation as that performed while the scan line G1 is selected. Through the above operations, an image for the first frame can be displayed on the pixel portion 631.

Note that in one embodiment of the present invention, the scan lines G1 to Gy are not necessarily selected sequentially.

It is possible to employ dot sequential driving in which the S signals 633_S are sequentially input to the signal lines S1 to Sx from the S driver circuit 633 or line sequential driving in which the S signals 633_S are input all at once. Alternatively, a driving method in which the S signals 633_S are sequentially input to every plural signal lines S may be employed.

In addition, the method for selecting the scan lines G is not limited to progressive scan; interlaced scan may be employed for selecting the scan lines G.

In given one frame period, the polarities of the S signals 633_S input to all the signal lines may be the same, or the polarities of the S signals 633_S to be input to the pixels may be inverted signal line by signal line.

<Writing Signals into Pixel Portion Divided into Plurality of Regions>

FIG. 9 illustrates a modification example of the structure of the display portion 630.

In the display portion 630 in FIG. 9, the plurality of pixels 631*p*, the plurality of scan lines G for selecting the pixels 631*p* row by row, and the plurality of signal lines S for supplying the S signals 633_S to the selected pixels 631*p* are provided in the pixel portion 631 divided into a plurality of regions (specifically, a first region 631*a*, a second region 631*b*, and a third region 631*c*).

The input of the G signals 632_G to the scan lines G in each region is controlled by the corresponding G driver circuit 632. The input of the S signals 633_S to the signal lines S is controlled by the S driver circuit 633. Each of the plurality of pixels 631*p* is connected to at least one of the scan lines G and at least one of the signal lines S.

Such a structure allows the pixel portion 631 to be divided into separately driven regions.

For example, the following operation is possible: when information is input from a touch panel used as the input unit 500, coordinates specifying a region to which the information is to be input are obtained, and the G driver circuit 632 driving the region corresponding to the coordinates operates in the first mode and the G driver circuit 632 driving the other region operates in the second mode. Thus, it is possible to stop the operation of the G driver circuit for a region where information has not been input from the touch panel, that is, a region where rewriting a displayed image is not necessary. Further, whether each region is driven in the first mode or the second mode may be determined in accordance with the proportion of pixels to which image signals having medium gray scale levels are input in each region. By this operation, generation of flickers can be suppressed, users' eye strain can be reduced, and eye-friendly display can be performed.

<2. G Driver Circuit in First Mode and Second Mode>

The S signal 633_S is input to the pixel circuit 634 to which the G signal 632_G output by the G driver circuit 632 is input. In a period during which the G signal 632_G is not input, the pixel circuit 634 holds the potential of the S signal 633_S. In other words, the pixel circuit 634 holds a state where the potential of the S signal 633_S is written in.

The pixel circuit 634 into which display data is written maintains a display state corresponding to the S signal 633_S. Note that to maintain a display state is to keep the amount of change in display state within a given range. This given range is set as appropriate, and is preferably set so that a user viewing displayed images can recognize the displayed images as the same image.

The G driver circuit 632 has the first mode and the second mode.

<2-1. First Mode>

The G driver circuit 632 in the first mode outputs the G signals 632_G to pixels at a frequency higher than or equal to 30 times per second, preferably higher than or equal to 60 times per second and lower than or equal to 960 times per second.

The G driver circuit 632 in the first mode rewrites signals at a speed such that change in images which occurs each time signals are rewritten is not recognized by the user. As a result, a smooth image can be displayed.

<2-2. Second Mode>

The G driver circuit 632 in the second mode outputs the G signals 632_G to pixels at a frequency higher than or equal to once per day and lower than or equal to ten times per second, preferably higher than or equal to once per hour and lower than or equal to once per second.

In a period during which the G signal 632_G is not input, the pixel circuit 634 keeps holding the S signal 633_S and maintains the display state corresponding to the potential of the S signal 633_S.

In this manner, display without flickers occurring due to rewriting the display on the pixels can be performed in the second mode.

As a result, eye strain of users of the information processing device having a display function can be reduced.

Power consumed by the G driver circuit 632 is reduced in a period during which the G driver circuit 632 does not operate.

Note that the pixel circuit that is driven by the G driver circuit 632 having the second mode is preferably configured to hold the S signal 633_S for a long period. For example, the off-state leakage current of the transistor 634*t* is preferably as low as possible.

Embodiments 6 and 7 can be referred to for examples of a structure of the transistor 634*t* with low off-state leakage current.

By employing the driving method of an information processing device described in this embodiment for the driving method of an information processing device described in Embodiment 1 and the program for driving the information processing device as described in Embodiment 1, users' eye strain can be reduced and eye-friendly display can be performed.

This embodiment can be combined with any of the other embodiments disclosed in this specification as appropriate.

Embodiment 4

In this embodiment, an example of a semiconductor device having a display function (also referred to as a display device) which can be applied to the display unit is described.

Figure 11B:
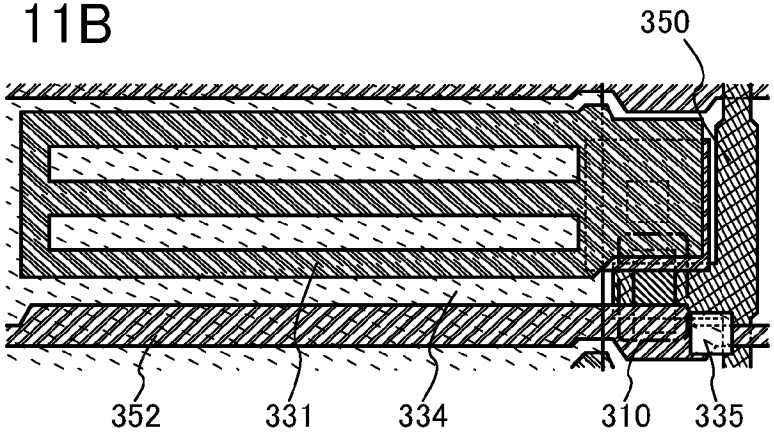
FIGS. 11A to 11C illustrate a structural example of a display device.
Figure 11A:
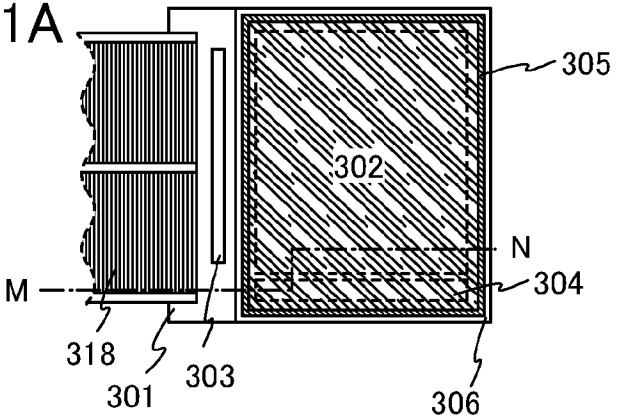

FIG. 11A is a plan view of a display device of this embodiment. In FIG. 11A, a sealant 305 is provided to surround a pixel portion 302 and a scan line driver circuit 304 which are provided over a substrate 301. A substrate 306 is provided over the pixel portion 302 and the scan line driver circuit 304. Consequently, the pixel portion 302 and the scan line driver circuit 304 are sealed together with the display element by the substrate 301, the sealant 305, and the substrate 306. In FIG. 11A, an IC chip or a signal line driver circuit 303 is formed using a single crystal semiconductor film or a polycrystalline semiconductor film over a substrate prepared separately, and mounted in a region different from the region surrounded by the sealant 305 over the substrate 301. A variety of signals and potentials are supplied from a flexible printed circuit (FPC) 318 to the pixel portion 302 through the signal line driver circuit 303 and the scan line driver circuit 304.

Although FIG. 11A shows an example in which the signal line driver circuit 303 is formed separately and mounted on the substrate 301, one embodiment of the present invention is not limited to this structure. The scan line driver circuit may be formed separately and then mounted, or only part of the signal line driver circuit or part of the scan line driver circuit may be formed separately and then mounted.

Note that a connection method of a separately formed driver circuit is not particularly limited, and a chip on glass (COG) method, a wire bonding method, a tape automated bonding (TAB) method, or the like can be used. FIG. 11A is an example in which the signal line driver circuit 303 is mounted by a COG method.

Note that the display device includes a panel in which the display element is sealed, and a module in which an IC including a controller or the like is mounted on the panel. In other words, the display device in this specification means an image display device or a light source (including a lighting device). Furthermore, the display device also includes the following modules in its category: a module to which a connector such as an FPC or a tape carrier package (TCP) is attached; a module having a TCP at the tip of which a printed wiring board is provided; and a module in which an integrated circuit (IC) is directly mounted on a display element by a COG method.

Further, the pixel portion and the scan line driver circuit provided over the substrate includes a plurality of transistors. There is no particular limitation on the structures of the transistors; however, it is preferable to use a transistor including an oxide semiconductor which is described in Embodiment 6.

As the display element provided in the display device, a liquid crystal element (also referred to as a liquid crystal display element) or a light-emitting element (also referred to as a light-emitting display element) can be used. The light-emitting element includes, in its category, an element whose luminance is controlled by a current or a voltage, and specifically includes, in its category, an inorganic electroluminescent (EL) element, an organic EL element, and the like. Furthermore, a display medium whose contrast is changed by an electric effect, such as an electronic ink display (electronic paper), can be used.

Figure 11C:
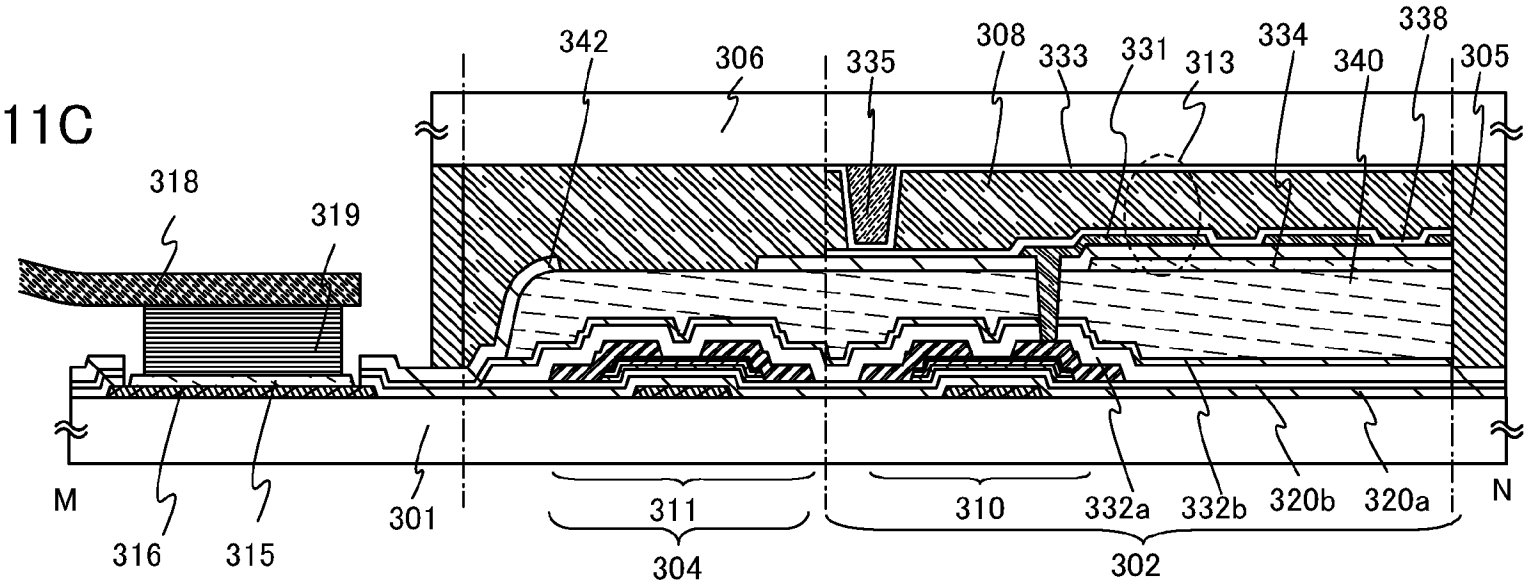

FIG. 11C is a cross-sectional view taken along a line M-N in FIG. 11A. An example of a liquid crystal display device using a liquid crystal element as a display element is described in FIGS. 11A to 11C. Note that a transistor 310 provided in the pixel portion 302 is electrically connected to a display element to form a display panel. A variety of display elements can be used as the display element as long as display can be performed.

A liquid crystal display device can employ a vertical electric field mode or a horizontal electric field mode. FIG. 11C illustrates an example in which a fringe field switching (FFS) mode is employed.

Modes which are different from the above can also be applied to a liquid crystal display device. For example, a vertical alignment (VA) mode, an in-plane-switching (IPS) mode, a twisted nematic (TN) mode, an axially symmetric aligned micro-cell (ASM) mode, an optically compensated birefringence (OCB) mode, a ferroelectric liquid crystal (FLC) mode, an antiferroelectric liquid crystal (AFLC) mode, or the like can be used.

As shown in FIGS. 11A and 11C, the semiconductor device includes a connection terminal electrode 315 and a terminal electrode 316. The connection terminal electrode 315 and the terminal electrode 316 are electrically connected to a terminal included in the FPC 318 through an anisotropic conductive film 319.

The connection terminal electrode 315 is formed from the same conductive layer as a first electrode layer 334. The terminal electrode 316 is formed from the same conductive layer as gate electrode layers of the transistor 310 and a transistor 311.

The pixel portion 302 and the gate line driver circuits 304 over the substrate 301 each include a plurality of transistors. FIG. 11C illustrates the transistor 310 included in the pixel portion 302 and the transistor 311 included in the scan line driver circuit 304, and insulating layers 332*a* and 332*b* are provided over the transistors 310 and 311.

In FIG. 11C, a planarization insulating layer 340 is provided over the insulating layer 332*b*, and an insulating layer 342 is provided between the first electrode layer 334 and a second electrode layer 331.

The transistor including an oxide semiconductor in a channel formation region which is described in Embodiment 6 can be used for each of the transistors 310 and 311. The transistors 310 and 311 are each a bottom gate transistor.

A gate insulating layer included in the transistors 310 and 311 can have a single layer structure or a stacked structure. In this embodiment, the gate insulating layer may have a stacked structure including gate insulating layers 320*a* and 320*b*. In FIG. 11C, the gate insulating layer 320*a* and the insulating layer 332*b* extend below the sealant 305 to cover the end portion of the connection terminal electrode 315, and the insulating layer 332*b* covers side surfaces of the gate insulating layer 320*b* and the insulating layer 332*a*.

A conductive layer may be further provided so as to overlap with the channel formation region in the oxide semiconductor layer of the transistor 311 for the driver circuit. In the case where a conductive layer is provided to overlap with the channel formation region in the oxide semiconductor layer, the amount of change in the threshold voltage of the transistor 311 can be reduced.

The conductive layer also has a function of blocking an external electric field, that is, a function of preventing an external electric field (particularly, a function of preventing static electricity) from effecting the inside (a circuit portion including a transistor). A blocking function of the conductive layer can prevent the variation in electrical characteristics of the transistor due to the effect of external electric field such as static electricity.

The planarization insulating layer 340 can be formed using an organic resin such as an acrylic resin, a polyimide resin, a benzocyclobutene-based resin, a polyamide resin, or an epoxy resin. Other than such organic materials, a low-dielectric constant material (a low-k material), a siloxane-based resin, or the like can be used. Impurities such as water in the planarization insulating layer 340 are preferably sufficiently reduced. With the planarization insulating layer 340, an extremely highly-reliable display device in which change in electrical characteristics or the transistor is small can be obtained.

In FIG. 11C, a liquid crystal element 313 includes the first electrode layer 334, the second electrode layer 331, and a liquid crystal layer 308. An insulating film 338 and an insulating film 333 serving as alignment films are provided so that the liquid crystal layer 308 is interposed therebetween.

As the a liquid crystal component contained in the liquid crystal layer 308, a thermotropic liquid crystal, a low molecular liquid crystal, a polymer liquid crystal, a ferroelectric liquid crystal, an anti-ferroelectric liquid crystal, or the like can be used. Moreover, a liquid crystal exhibiting a blue phase is preferably used because an alignment film is not necessary and the viewing angle is wide. It is also possible to use a polymer-stabilized liquid crystal material which is obtained by adding a monomer and a polymerization initiator to the above liquid crystal and, after injection or dispensing and sealing of the liquid crystal, polymerizing the monomer.

In the liquid crystal element 313, the second electrode layer 331 having an opening pattern is provided below the liquid crystal layer 308, and the first electrode layer 334 having a flat plate shape is provided below the second electrode layer 331 with the insulating layer 342 provided therebetween. The second electrode layer 331 having an opening pattern includes a bent portion or a branched comb-shaped portion. The provision of the opening pattern for the second electrode layer 331 enables an electric field to be generated between electrodes of the first electrode layer 334 and the second electrode layer 331. Note that a structure may be employed in which the second electrode layer 331 having a flat plate shape is formed on and in contact with the planarization insulating layer 340, and the first electrode layer 334 having an opening pattern and serving as a pixel electrode is formed over the second electrode layer 331 with the insulating layer 342 provided therebetween.

The first electrode layer 334 and the second electrode layer 331 can be formed using a light-transmitting conductive material such as indium oxide containing tungsten oxide, indium zinc oxide containing tungsten oxide, indium oxide containing titanium oxide, indium tin oxide containing titanium oxide, indium tin oxide, indium zinc oxide, indium tin oxide to which silicon oxide is added, or graphene.

Alternatively, the first electrode layer 334 and the second electrode layer 331 can be formed using one or more materials selected from metals such as tungsten (W), molybdenum (Mo), zirconium (Zr), hafnium (Hf), vanadium (V), niobium (Nb), tantalum (Ta), chromium (Cr), cobalt (Co), nickel (Ni), titanium (Ti), platinum (Pt), aluminum (Al), copper (Cu), and silver (Ag); an alloy of any of these metals; and a nitride of any of these metals.

A conductive composition containing a conductive high molecule (also referred to as conductive polymer) can be used for the first electrode layer 334 and the second electrode layer 331.

A spacer 335 is a columnar spacer obtained by selective etching of an insulating layer and is provided in order to adjust the thickness of the liquid crystal layer 308 (a cell gap). Alternatively, a spherical spacer may be used.

Alternatively, a liquid crystal composition exhibiting a blue phase for which an alignment film is unnecessary may be used for the liquid crystal layer 308. In this case, the liquid crystal layer 308 is in contact with the first electrode layer 334 and the second electrode layer 331.

Note that the insulating layer 342 illustrated in FIG. 11C partly has an opening; thus, moisture included in the planarization insulating layer 340 can be released through the opening. However, the opening is not necessarily provided depending on the quality of the insulating layer 342 over the planarization insulating layer 340.

The size of a storage capacitor provided in the liquid crystal display device is set considering the leakage current of the transistor provided in the pixel portion or the like so that charge can be held for a predetermined period. The size of the storage capacitor may be set considering the off-state current of a transistor or the like. By using a transistor including the oxide semiconductor layer disclosed in this specification, the size of the storage capacitor can be reduced. Accordingly, the aperture ratio of each pixel can be improved.

In particular, it is preferable that a capacitor as a storage capacitor be not provided and that parasitic capacitance generated between the first electrode layer 334 and the second electrode layer 331 be used as a storage capacitor. Without the capacitor, the aperture ratio of a pixel can be further increased.

FIG. 11B illustrates an example of a pixel structure in the case where the capacitor as a storage capacitor is not provided for a pixel. The pixel has an intersection portion of a wiring 350 electrically connected to the gate electrode layer of the transistor 310 and a wiring 352 electrically connected to one of a source electrode layer and a drain electrode layer of the transistor 310. Since the pixel in FIG. 11B does not include the capacitor as a storage capacitor, the ratio of the area of the second electrode layer 331 having an opening pattern to the area occupied by the pixel can be made large, and an extremely high aperture ratio can be obtained.

In the transistor including an oxide semiconductor layer, which is disclosed in this specification, the current in an off state (off-state current) can be made small. Accordingly, an electric signal such as image data can be held for a longer period and a writing interval can be set longer. Accordingly, the frequency of refresh operation can be reduced, which leads to an effect of suppressing power consumption.

The transistor including an oxide semiconductor layer, which is disclosed in this specification, can have high field-effect mobility; thus, the transistor can operate at high speed. For example, when such a transistor is used for a liquid crystal display device, a switching transistor in a pixel portion and a driver transistor in a driver circuit portion can be formed over one substrate. In addition, by using such a transistor in a pixel portion, a high-quality image can be provided.

In the display device, a black matrix (a light-blocking layer), an optical member (an optical substrate) such as a polarizing member, a retardation member, or an anti-reflection member, and the like are provided as appropriate. For example, circular polarization may be employed using a polarizing plate or a retardation substrate. In addition, a backlight, a side light, or the like may be used as a light source.

As a display method in the pixel portion, a progressive method, an interlace method, or the like can be employed. Further, color elements controlled in a pixel at the time of color display are not limited to three colors: R, G, and B (R, G, and B correspond to red, green, and blue, respectively). For example, R, G, B, and W (W corresponds to white), or R, G, B, and one or more of yellow, cyan, magenta, and the like can be used. Further, the sizes of display regions may be different between respective dots of color elements. Note that the disclosed invention is not limited to the application to a display device for color display; the disclosed invention can also be applied to a display device for monochrome display.

In addition, the display device is preferably provided with a touch sensor. More intuitively operable electronic devices can be each obtained by using a display device with a touch sensor for an electronic device or the like so that the display device overlaps with the pixel portion 302. The touch sensor described here can be used as the above-described input unit.

As the touch sensor provided for the display device, a capacitive touch sensor is preferably used. In addition, a variety of types such as a resistive type, a surface acoustic wave type, an infrared type, and an optical type can be used.

Examples of the capacitive touch sensor are typically of a surface capacitive type, a projected capacitive type, and the like. Further, examples of the projected capacitive type are of a self capacitive type, a mutual capacitive type, and the like mainly in accordance with the difference in the driving method. The use of a mutual capacitive type is preferable because multiple points can be sensed simultaneously.

When a touch sensor is provided for the display device, a layer functioning as a touch sensor can be arranged in various ways.

Figure 12A:
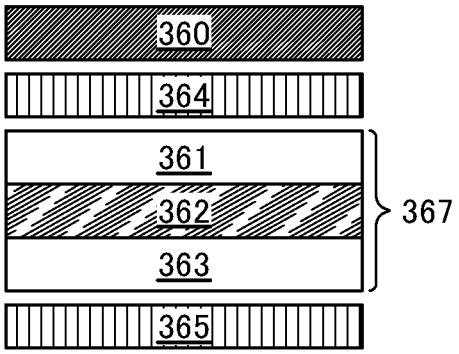
FIGS. 12A to 12C each illustrate a structural example of a display device provided with a touch sensor.
Figure 12B:
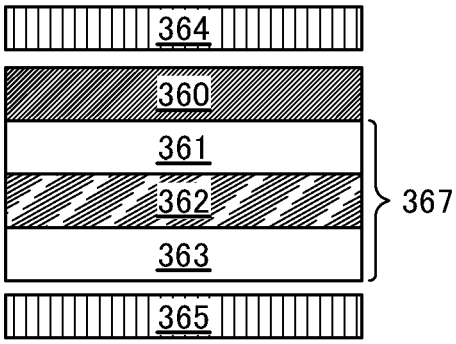
Figure 12C:
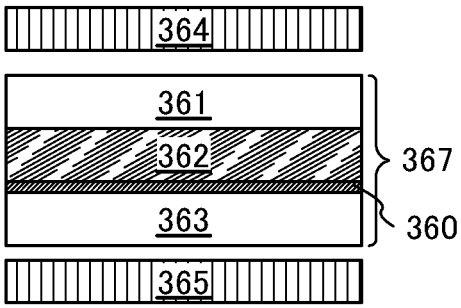

FIGS. 12A to 12C each illustrate a structural example of a display device including a liquid crystal element and a touch sensor.

The display device in FIG. 12A includes a liquid crystal 362, a pair of substrates (substrates 361 and 363) provided with the liquid crystal 362 therebetween, a pair of polarizing plates (polarizing plates 364 and 365) provided outside the substrates 361 and 363, and a touch sensor 360. Here, a structure including the liquid crystal 362 and the substrates 361 and 363 are referred to as a display panel 367.

The display device in FIG. 12A is a so-called external display device in which the touch sensor 360 is placed outside the polarizing plate 364 (or the polarizing plate 365). With such a structure, the display device can have a touch sensor function in such a manner that the display panel 367 and the touch sensor 360 are separately formed and then they are overlapped with each other. Thus, the display device in FIG. 12A can be easily manufactured without a special step.

Here, in the display device illustrated in FIG. 12A, the touch sensor 360 is preferably provided over a tempered glass. Physical or chemical processing by an ion exchange method, a wind tempering method, or the like is performed on the tempered glass, so that compressive stress is applied on the surface. In the case where the touch sensor is provided on one side of the tempered glass and the opposite side of the tempered glass is provided on, for example, the outermost surface of an electronic device to use as a touch surface, the whole thickness of the device can be reduced.

The display device in FIG. 12B is a so-called on-cell display device in which the touch sensor 360 is positioned between the polarizing plate 364 and the substrate 361 (or between the polarizing plate 365 and the substrate 363). With such a structure, the thickness of the display device can be reduced by using the substrate 361 in common with a formation substrate of the touch sensor 360, for example.

The display device in FIG. 12C is a so-called in-cell display device in which the touch sensor 360 is positioned between the substrate 361 and the substrate 363. With such a structure, the thickness of the display device can be further reduced. For example, this can be realized in such a manner that a layer functioning as a touch sensor is formed on the liquid crystal 362 side of a surface of the substrate 361 (or the substrate 363) with the use of a transistor, a wiring, an electrode, and the like included in the display panel 367. Further, in the case of using an optical touch sensor, a structure provided with a photoelectric conversion element may be employed.

Note that the display device including a liquid crystal element is described here; however, a function of a touch sensor can be properly added to various display devices such as a display device provided with an organic EL element and electronic paper.

Note that a more specific structural example of the touch sensor is described in Embodiment 5.

The semiconductor device having a display function (the display device) described in this embodiment can be applied to a display unit included in the information processing device of one embodiment of the present invention. Thus, the semiconductor device having a display function described in this embodiment can reduce users' eye strain and perform eye-friendly display by employing the driving method of an information processing device described in Embodiment 1 and making the arithmetic unit execute a program for driving the information processing device as described in Embodiment 1.

This embodiment can be combined with any of the other embodiments disclosed in this specification as appropriate.

Embodiment 5

In this embodiment, a structural example of a sensor that can sense proximity or touch of an object (also referred to as a touch sensor) and can be applied to the above semiconductor device is described.

[Example of Detection Method of Sensor]

Figure 13A:
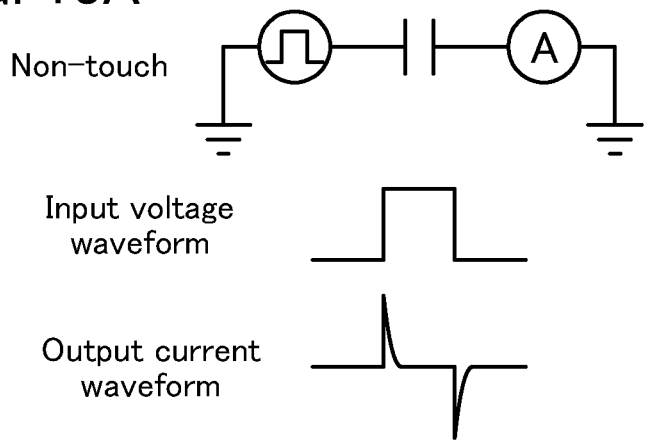
FIGS. 13A to 13C illustrate touch sensors.
Figure 13B:
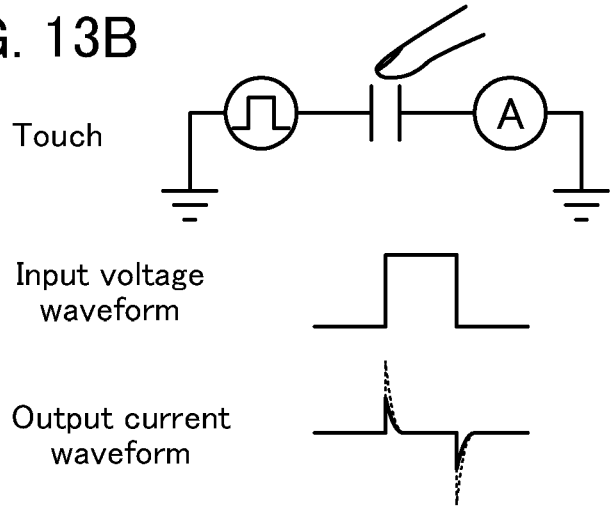

FIGS. 13A and 13B are schematic diagrams each illustrating a structure of a mutual capacitive touch sensor and input and output waveforms. The touch sensor includes a pair of electrodes. Capacitance is formed between the pair of electrodes. Input voltage is input to one of the pair of electrodes. Further, a detection circuit which detects current flowing in the other electrode (or a potential of the other electrode) is provided.

For example, in the case where a rectangular wave is used as an input voltage waveform as illustrated in FIG. 13A, a waveform having a sharp peak is detected as an output current waveform.

Further, in the case where an object having conductivity is close to or touches a capacitor as illustrated in FIG. 13B, the capacitance value between the electrodes is decreased; accordingly, the current value is decreased.

By detecting a change in capacitance by using a change in output current (or potential) with respect to input voltage in this manner, proximity or a touch of an object can be detected.

[Structural Example of Touch Sensor]

Figure 13C:
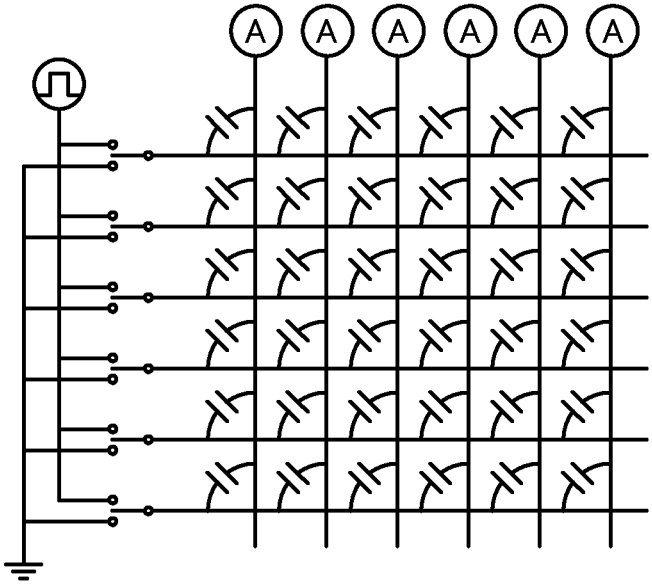

FIG. 13C illustrates a structural example of a touch sensor provided with a plurality of capacitors arranged in a matrix.

The touch sensor includes a plurality of wirings extending in an X direction (the horizontal direction of this figure) and a plurality of wirings extending in a Y direction (the vertical direction of this figure) which intersect with the plurality of wirings. Capacitance is formed between two wirings intersecting with each other.

One of input voltage and a common potential (including a grounded potential and a reference potential) is input to each of the wirings extending in the X direction. Further, a detection circuit (e.g., a source meter or a sense amplifier) is electrically connected to the wirings extending in the Y direction and can detect current (or potential) flowing through the wirings.

The touch sensor can perform sensing two dimensionally in such a manner that input voltage is sequentially input to the plurality of wirings extending in the X direction and detects a change in current (or potential) flowing through the wirings extending in the Y direction.

[Structural Example of Touch Panel]

A structural example of a touch panel incorporating the touch sensor into a display portion including a plurality of pixels is described below. Here, an example where a liquid crystal element is used as a display element provided in the pixel is shown.

Figure 14A:
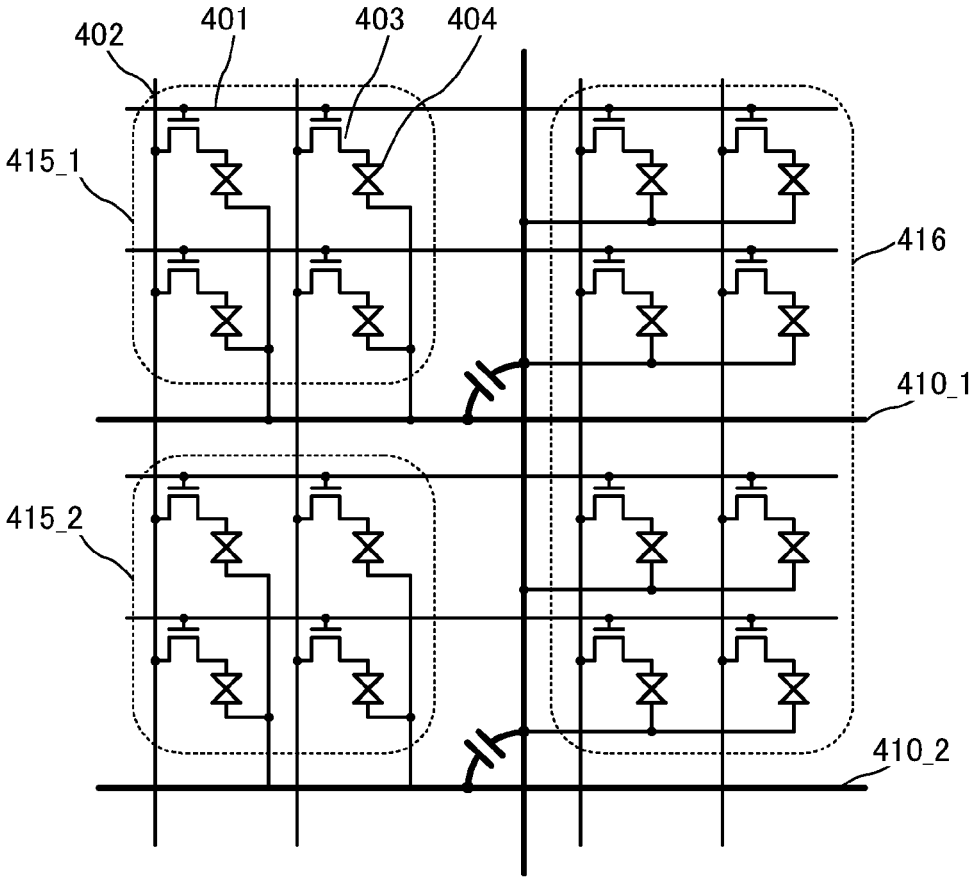
FIGS. 14A and 14B illustrate pixels including touch sensors.

FIG. 14A is an equivalent circuit diagram of part of a pixel circuit provided in the display portion of the touch panel described in this structural example.

Each pixel includes at least a transistor 403 and a liquid crystal element 404. In addition, a gate of the transistor 403 is electrically connected to a wiring 401 and one of a source and a drain of the transistor 403 is electrically connected to a wiring 402.

The pixel circuit includes a plurality of wirings extending in the X direction (e.g., a wiring 410_1 and a wiring 410_2) and a plurality of wirings extending in the Y direction (e.g., a wiring 411). They are provided to intersect with each other, and capacitance is formed therebetween.

Among the pixels provided in the pixel circuit, ones of electrodes of the liquid crystal elements of some pixels adjacent to each other are electrically connected to each other to form one block. The block is classified into two types: an island-shaped block (e.g., a block 415_1 or a block 415_2) and a linear block (e.g., a block 416) extending in the Y direction.

The wiring 410_1 (or 410_2) extending in the X direction is electrically connected to the island-shaped block 415_1 (or the block 415_2). Further, the wiring 411 extending in the Y direction is electrically connected to the linear block 416.

Figure 14B:
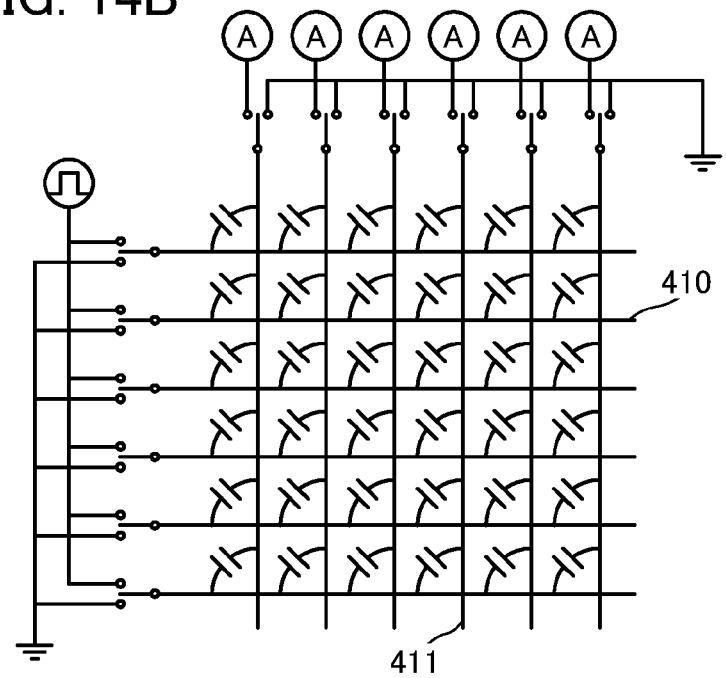

FIG. 14B is an equivalent circuit diagram in which a plurality of wirings 410 extending in the X direction and the plurality of wirings 411 extending in the Y direction are illustrated. Input voltage or a common potential can be input to each of the wirings 410 extending in the X direction. Further, a ground potential can be input to each of the wirings 411 extending in the Y direction or the wirings 411 can be electrically connected to the detection circuit.

[Example of Operation of Touch Panel]

Operation of the above-described touch panel is described with reference to FIGS. 15A and 15B and FIG. 16.

Figure 16:
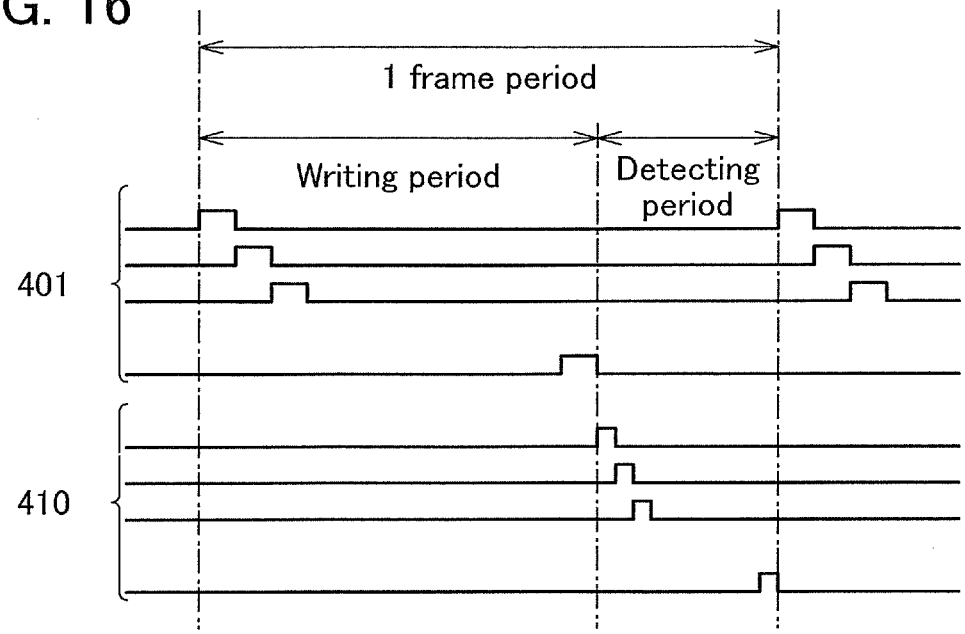
FIG. 16 illustrates the operation of touch sensors and pixels.

As illustrated in FIG. 16, one frame period is divided into a writing period and a detecting period. The writing period is a period in which image data is written to a pixel, and the wirings 410 (also referred to as gate lines) are sequentially selected. On the other hand, the detecting period is a period in which sensing is performed by a touch sensor, and the wirings 410 extending in the X direction are sequentially selected and input voltage is input.

Figure 15A:
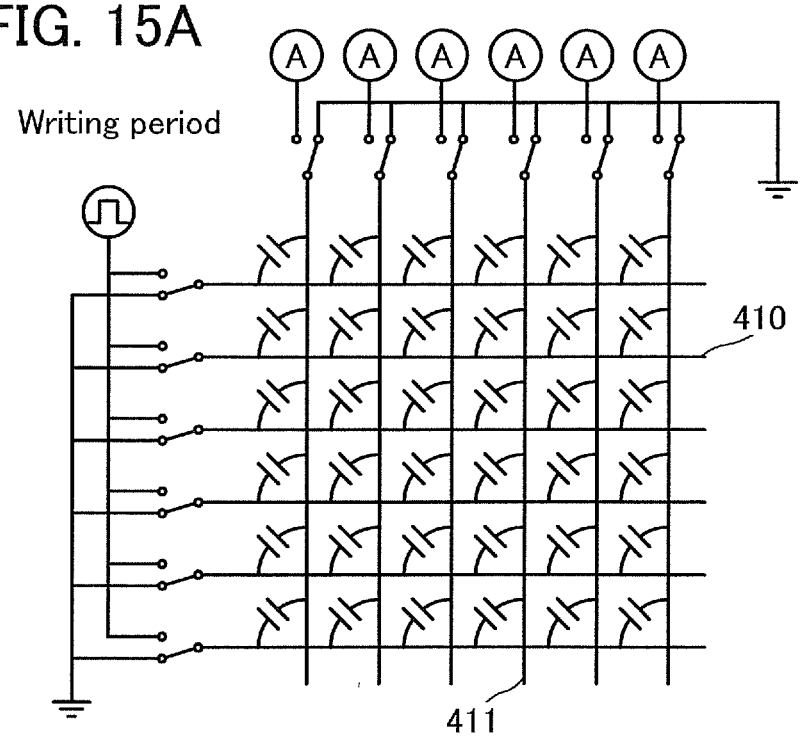
FIGS. 15A and 15B illustrate the operation of touch sensors and pixels.

FIG. 15A is an equivalent circuit diagram in the writing period. In the wiring period, a common potential is input to both the wiring 410 extending in the X direction and the wiring 411 extending in the Y direction.

Figure 15B:
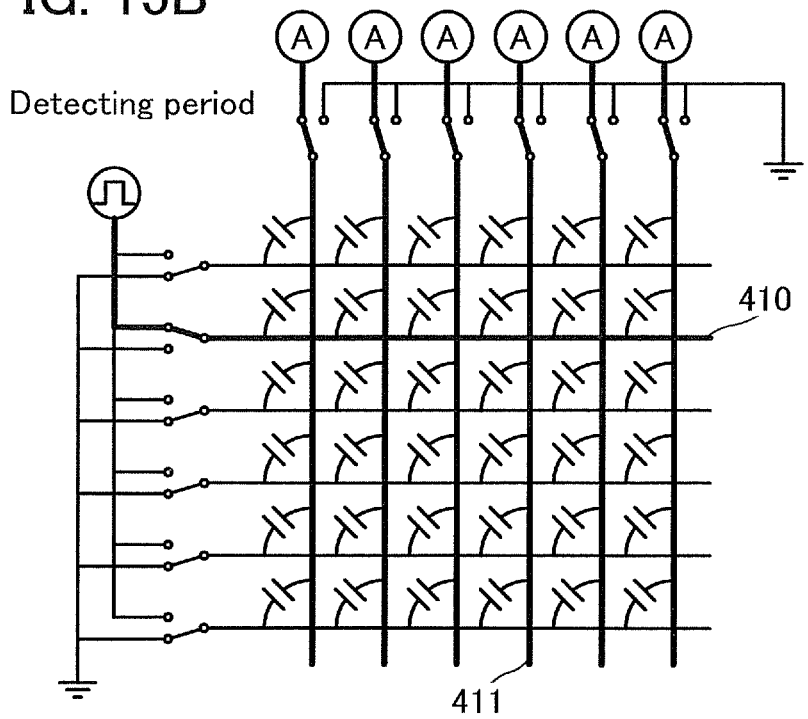

FIG. 15B is an equivalent circuit diagram at some point in time in the detection period. In the detection period, each of the wirings 411 extending in the Y direction is electrically connected to the detection circuit. Input voltage is input to the wirings 410 extending in the X direction which are selected, and a common potential is input to the wirings 410 extending in the X direction which are not selected.

It is preferable that a period in which an image is written and a period in which sensing is performed by a touch sensor be separately provided as described above. Thus, a decrease in sensitivity of the touch sensor caused by noise generated when data is written to a pixel can be suppressed.

[Structural Examples of Pixel]

Structural examples of a pixel which can be used for the above touch panel are described below.

Figure 17A:
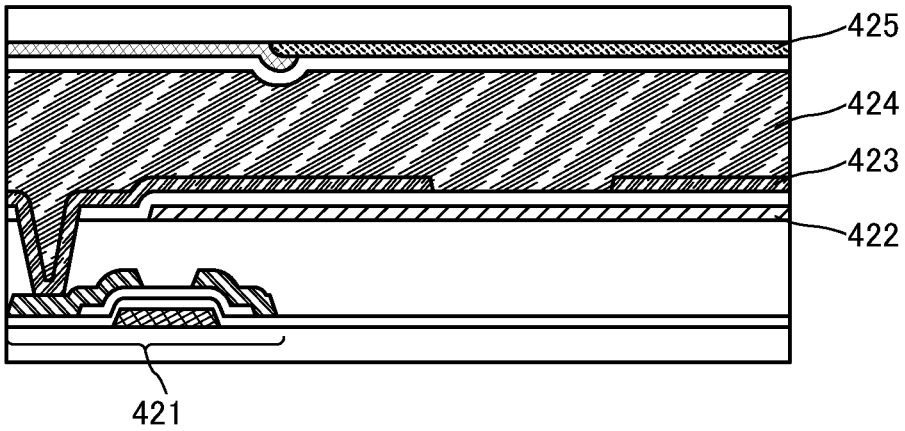
FIGS. 17A to 17C illustrate structures of a pixel.

FIG. 17A is a schematic cross-sectional view illustrating part of a pixel using a fringe field switching (FFS) mode.

The pixel includes a transistor 421, an electrode 422, an electrode 423, a liquid crystal 424, and a color filter 425. The electrode 423 having an opening is electrically connected to one of a source and a drain of the transistor 421. The electrode 423 is provided over the electrode 422 with an insulating layer provided therebetween. The electrode 423 and the electrode 422 can each function as one electrode of a liquid crystal element, and by applying voltage to the liquid crystal element, alignment of liquid crystals can be controlled.

For example, the electrode 422 is electrically connected to the above-described wiring 410 or wiring 411; thus, the pixel of the above-described touch panel can be formed.

Note that the electrode 422 can be provided over the electrode 423. In that case, the electrode 422 may have an opening and may be provided over the electrode 423 with an insulating layer provided therebetween.

Figure 17B:
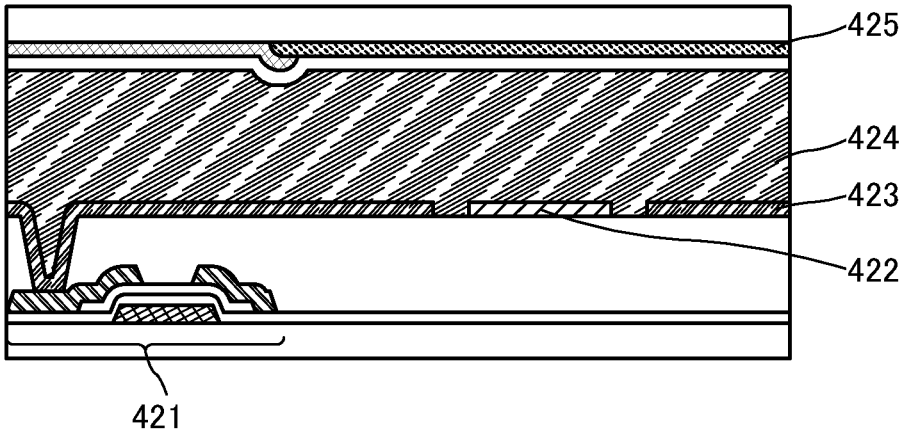

FIG. 17B is a schematic cross-sectional view illustrating part of a pixel having an in-plane-switching (IPS) mode.

The electrode 423 and electrode 422 provided in the pixel each have a comb-like shape and are provided on the same plane.

For example, the electrode 422 is electrically connected to the above-described wiring 410 or wiring 411; thus, the pixel of the above-described touch panel can be formed.

Figure 17C:
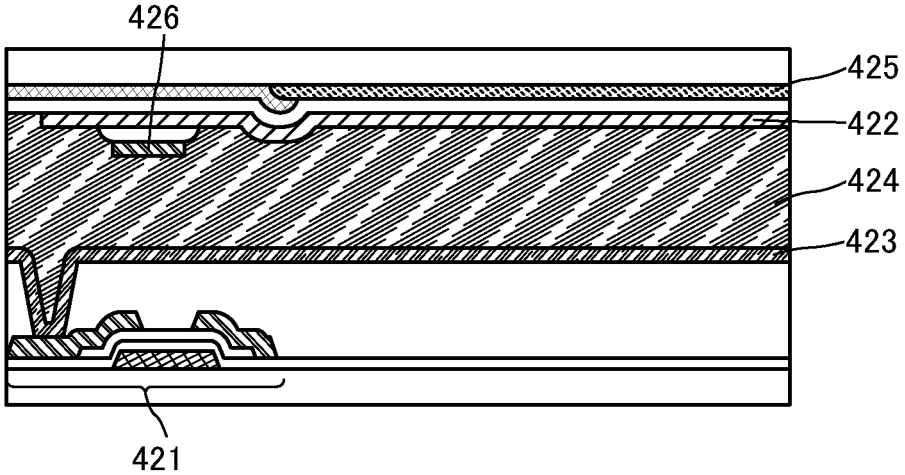

FIG. 17C is a schematic cross-sectional view illustrating part of a pixel having a vertical alignment (VA) mode of a liquid crystal display device.

The electrode 422 is provided so as to face the electrode 423 with the liquid crystal 424 provided therebetween. The wiring 426 is provided to overlap with the electrode 422. For example, the wiring 426 can be provided to electrically connect the block including the pixel illustrated in FIG. 17C and blocks different from the block including the pixel illustrated in FIG. 17C.

For example, the electrode 422 is electrically connected to the above-described wiring 410 or wiring 411; thus, the pixel of the above-described touch panel can be formed.

This embodiment can be combined with any of the other embodiments disclosed in this specification as appropriate.

Embodiment 6

An example of a semiconductor and a semiconductor film which are preferably used for the region where a channel is formed in the transistor which is shown as an example in the above embodiment is described below.

An oxide semiconductor has a wide energy gap of 3.0 eV or more. A transistor including an oxide semiconductor film obtained by processing the oxide semiconductor under appropriate conditions and reducing the carrier density sufficiently can have much lower leakage current between a source and a drain in an off state (off-state current) than a conventional transistor including silicon.

In the case where an oxide semiconductor film is used for a transistor, the thickness of the oxide semiconductor film is preferably greater than or equal to 2 nm and less than or equal to 40 nm.

An oxide semiconductor applicable to a transistor preferably contains at least indium (In) or zinc (Zn). In particular, In and Zn are preferably contained. In addition, as a stabilizer for reducing variation in electrical characteristics of a transistor using the oxide semiconductor, one or more elements selected from gallium (Ga), tin (Sn), hafnium (Hf), zirconium (Zr), titanium (Ti), scandium (Sc), yttrium (Y), and a lanthanoid (such as cerium (Ce), neodymium (Nd), or gadolinium (Gd)) is preferably contained.

As the oxide semiconductor, for example, any of the following can be used: indium oxide, tin oxide, zinc oxide, an In—Zn-based oxide, a Sn—Zn-based oxide, an Al—Zn-based oxide, a Zn—Mg-based oxide, a Sn—Mg-based oxide, an In—Mg-based oxide, an In—Ga-based oxide, an In—Ga—Zn-based oxide (also referred to as IGZO), an In—Al—Zn-based oxide, an In—Sn—Zn-based oxide, a Sn—Ga—Zn-based oxide, an Al—Ga—Zn-based oxide, a Sn—Al—Zn-based oxide, an In—Hf—Zn-based oxide, an In—Zr—Zn-based oxide, an In—Ti—Zn-based oxide, an In—Sc—Zn-based oxide, an In—Y—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, an In—Lu—Zn-based oxide, an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, or an In—Hf—Al—Zn-based oxide.

Here, an "In—Ga—Zn-based oxide" means an oxide containing In, Ga, and Zn as its main components and there is no particular limitation on the ratio of In, Ga, and Zn. Further, the In—Ga—Zn-based oxide may contain a metal element other than In, Ga, and Zn.

Alternatively, a material represented by $InMO_3(ZnO)_m$ ($m>0$ is satisfied, and m is not an integer) may be used as the oxide semiconductor. Note that M represents one or more metal elements selected from Ga, Fe, Mn, and Co, or the above-described element as a stabilizer. Alternatively, as the oxide semiconductor, a material represented by $In_2SnO_5(ZnO)_n$ ($n>0$ is satisfied, and n is an integer) may be used.

For example, an In—Ga—Zn-based oxide with an atomic ratio of In:Ga:Zn=1:1:1, In:Ga:Zn=1:3:2, In:Ga:Zn=3:1:2, or In:Ga:Zn=2:1:3, or an oxide with an atomic ratio close to the above atomic ratios can be used.

When the oxide semiconductor film contains a large amount of hydrogen, the hydrogen and the oxide semiconductor are bonded to each other, so that part of the hydrogen becomes donors and causes generation of electrons serving as carriers. As a result, the threshold voltage of the transistor shifts in the negative direction. Therefore, it is preferable that, after formation of the oxide semiconductor film, dehydration treatment (dehydrogenation treatment) be performed to remove hydrogen or moisture from the oxide semiconductor film so that the oxide semiconductor film is highly purified to contain impurities as little as possible.

Note that oxygen in the oxide semiconductor film is also reduced by the dehydration treatment (dehydrogenation treatment) in some cases. Accordingly, it is preferable that oxygen be added to the oxide semiconductor film to fill oxygen vacancies increased by the dehydration treatment (dehydrogenation treatment). In this specification and the like, supplying oxygen to an oxide semiconductor film may be expressed as oxygen adding treatment, or treatment for making the oxygen content of an oxide semiconductor film be in excess of that of the stoichiometric composition may be expressed as treatment for making an oxygen-excess state.

In this manner, hydrogen or moisture is removed from the oxide semiconductor film by the dehydration treatment (dehydrogenation treatment) and oxygen vacancies therein are filled by the oxygen adding treatment, whereby the oxide semiconductor film can be turned into an i-type (intrinsic) oxide semiconductor film or a substantially i-type (intrinsic) oxide semiconductor film which is extremely close to an i-type oxide semiconductor film. Note that "substantially intrinsic" means that the oxide semiconductor film contains extremely few (close to zero) carriers derived from a donor and has a carrier density of lower than or equal to $1\times10^{17}/cm^3$, preferably lower than or equal to $1\times10^{16}/cm^3$, further preferably lower than or equal to $1\times10^{15}/cm^3$, still further preferably lower than or equal to $1\times10^{14}/cm^3$, or yet still further preferably lower than or equal to $1\times10^{13}/cm^3$.

Thus, the transistor including an i-type or substantially i-type oxide semiconductor film can have extremely favorable off-state current characteristics. For example, the drain current at the time when the transistor including an oxide semiconductor film is in an off-state can be less than or equal to $1\times10^{-18}$ A, preferably less than or equal to $1\times10^{-21}$ A, further preferably less than or equal to $1\times10^{-24}$ A at room temperature (about 25° C.); or less than or equal to $1\times10^{-15}$ A, preferably less than or equal to $1\times10^{-18}$ A, further preferably less than or equal to $1\times10^{-21}$ A at 85° C. An off state of a transistor refers to a state where gate voltage is sufficiently lower than the threshold voltage in an n-channel transistor.

Specifically, the transistor is in an off state when the gate voltage is lower than the threshold voltage by 1V or more, 2V or more, or 3V or more.

A structure of an oxide semiconductor film is described below.

An oxide semiconductor film is classified roughly into a single-crystal oxide semiconductor film and a non-single-crystal oxide semiconductor film. The non-single-crystal oxide semiconductor film includes any of an amorphous oxide semiconductor film, a microcrystalline oxide semiconductor film, a polycrystalline oxide semiconductor film, a c-axis aligned crystalline oxide semiconductor (CAAC-OS) film, and the like.

The amorphous oxide semiconductor film has disordered atomic arrangement and no crystalline component. A typical example thereof is an oxide semiconductor film in which no crystal part exists even in a microscopic region, and the whole of the film is amorphous.

The microcrystalline oxide semiconductor film includes a microcrystal (also referred to as nanocrystal) with a size greater than or equal to 1 nm and less than 10 nm, for example. Thus, the microcrystalline oxide semiconductor film has a higher degree of atomic order than the amorphous oxide semiconductor film. Hence, the density of defect states of the microcrystalline oxide semiconductor film is lower than that of the amorphous oxide semiconductor film.

The CAAC-OS film is one of oxide semiconductor films including a plurality of crystal parts, and most of the crystal parts each fit inside a cube whose one side is less than 100 nm. Thus, there is a case where a crystal part included in the CAAC-OS film fits a cube whose one side is less than 10 nm, less than 5 nm, or less than 3 nm. The density of defect states of the CAAC-OS film is lower than that of the microcrystalline oxide semiconductor film. The CAAC-OS film is described in detail below.

In a transmission electron microscope (TEM) image of the CAAC-OS film, a boundary between crystal parts, that is, a grain boundary is not clearly observed. Thus, in the CAAC-OS film, a reduction in electron mobility due to the grain boundary is less likely to occur.

According to the TEM image of the CAAC-OS film observed in a direction substantially parallel to a sample surface (cross-sectional TEM image), metal atoms are arranged in a layered manner in the crystal parts. Each metal atom layer has a morphology reflected by a surface over which the CAAC-OS film is formed (hereinafter, a surface over which the CAAC-OS film is formed is referred to as a formation surface) or a top surface of the CAAC-OS film, and is arranged in parallel to the formation surface or the top surface of the CAAC-OS film.

On the other hand, according to the TEM image of the CAAC-OS film observed in a direction substantially perpendicular to the sample surface (plan TEM image), metal atoms are arranged in a triangular or hexagonal configuration in the crystal parts. However, there is no regularity of arrangement of metal atoms between different crystal parts.

From the results of the cross-sectional TEM image and the plan TEM image, alignment is found in the crystal parts in the CAAC-OS film.

A CAAC-OS film is subjected to structural analysis with an X-ray diffraction (XRD) apparatus. For example, when the CAAC-OS film including an $InGaZnO_4$ crystal is analyzed by an out-of-plane method, a peak appears frequently when the diffraction angle ($2\theta$) is around 31°. This peak is derived from the (009) plane of the $InGaZnO_4$ crystal, which indicates that crystals in the CAAC-OS film have c-axis alignment, and that the c-axes are aligned in a direction substantially perpendicular to the formation surface or the top surface of the CAAC-OS film.

On the other hand, when the CAAC-OS film is analyzed by an in-plane method in which an X-ray enters a sample in a direction substantially perpendicular to the c-axis, a peak appears frequently when $2\theta$ is around 56°. This peak is derived from the (110) plane of the $InGaZnO_4$ crystal. Here, analysis ($\phi$ scan) is performed under conditions where the sample is rotated around a normal vector of a sample surface as an axis ($\phi$ axis) with $2\theta$ fixed at around 56°. In the case where the sample is a single-crystal oxide semiconductor film of $InGaZnO_4$, six peaks appear. The six peaks are derived from crystal planes equivalent to the (110) plane. On the other hand, in the case of a CAAC-OS film, a peak is not clearly observed even when $\phi$ scan is performed with $2\theta$ fixed at around 56°.

According to the above results, in the CAAC-OS film having c-axis alignment, while the directions of a-axes and b-axes are different between crystal parts, the c-axes are aligned in a direction parallel to a normal vector of a formation surface or a normal vector of a top surface. Thus, each metal atom layer arranged in a layered manner observed in the cross-sectional TEM image corresponds to a plane parallel to the a-b plane of the crystal.

Note that the crystal part is formed concurrently with deposition of the CAAC-OS film or is formed through crystallization treatment such as heat treatment. As described above, the c-axis of the crystal is aligned with a direction parallel to a normal vector of a formation surface or a normal vector of a top surface. Thus, for example, in the case where a shape of the CAAC-OS film is changed by etching or the like, the c-axis might not be necessarily parallel to a normal vector of a formation surface or a normal vector of a top surface of the CAAC-OS film.

Further, the degree of crystallinity in the CAAC-OS film is not necessarily uniform. For example, in the case where crystal growth leading to the CAAC-OS film occurs from the vicinity of the top surface of the film, the degree of the crystallinity in the vicinity of the top surface is higher than that in the vicinity of the formation surface in some cases. Further, when an impurity is added to the CAAC-OS film, the crystallinity in a region to which the impurity is added is changed, and the degree of crystallinity in the CAAC-OS film varies depends on regions.

Note that when the CAAC-OS film with an $InGaZnO_4$ crystal is analyzed by an out-of-plane method, a peak of $2\theta$ may also be observed at around 36°, in addition to the peak of $2\theta$ at around 31°. The peak of $2\theta$ at around 36° indicates that a crystal having no c-axis alignment is included in part of the CAAC-OS film. It is preferable that in the CAAC-OS film, a peak of $2\theta$ appear at around 31° and a peak of $2\theta$ do not appear at around 36°.

In a transistor including the CAAC-OS film, change in electrical characteristics due to irradiation with visible light or ultraviolet light is small. Thus, the transistor has high reliability.

Note that an oxide semiconductor film may be a stacked film including two or more kinds of an amorphous oxide semiconductor film, a microcrystalline oxide semiconductor film, and a CAAC-OS film, for example.

For example, a CAAC-OS film can be deposited by a sputtering method using a polycrystalline oxide semiconductor sputtering target. When ions collide with the sputtering target, a crystal region included in the sputtering target may be separated from the target along an a-b plane; in other words, a sputtered particle having a plane parallel to an a-b plane (flat-plate-like sputtered particle or pellet-like sputtered particle) may flake off from the sputtering target. In that case, the flat-plate-like sputtered particle or the pellet-like sputtered particle reaches a surface where the CAAC-OS film is to be deposited while maintaining its crystal state, whereby the CAAC-OS film can be deposited.

The flat-plate-like sputtered particle has, for example, an equivalent circle diameter of a plane parallel to the a-b plane of greater than or equal to 3 nm and less than or equal to 10 nm, and a thickness (length in the direction perpendicular to the a-b plane) of greater than or equal to 0.7 nm and less than 1 nm. Note that in the flat-plate-like sputtered particle, the plane parallel to the a-b plane may be a regular triangle or a regular hexagon. Here, the term "equivalent circle diameter of a plane" refers to the diameter of a perfect circle having the same area as the plane.

For the deposition of the CAAC-OS film, the following conditions are preferably used.

When the substrate temperature during the deposition is increased, migration of the flat-plate-like sputtered particles which have reached the substrate occurs, so that a flat plane of each sputtered particle is attached to the substrate. At this time, the sputtered particles are positively charged, thereby being attached to the substrate while repelling each other; thus, the sputtered particles are not stacked unevenly, so that a CAAC-OS film with a uniform thickness can be deposited. Specifically, the substrate temperature during the deposition is preferably higher than or equal to 100° C. and lower than or equal to 740° C., further preferably higher than or equal to 200° C. and lower than or equal to 500° C.

By reducing the amount of impurities entering the CAAC-OS film during the deposition, the crystal state can be prevented from being broken by the impurities. For example, the concentration of impurities (e.g., hydrogen, water, carbon dioxide, or nitrogen) which exist in a deposition chamber may be reduced. Furthermore, the concentration of impurities in a deposition gas may be reduced. Specifically, a deposition gas whose dew point is −80° C. or lower, preferably −100° C. or lower is used.

Furthermore, it is preferable that the proportion of oxygen in the deposition gas be increased and the power be optimized in order to reduce plasma damage at the deposition. The proportion of oxygen in the deposition gas is 30 vol % or higher, preferably 100 vol %.

After the CAAC-OS film is deposited, heat treatment may be performed. The temperature of the heat treatment is higher than or equal to 100° C. and lower than or equal to 740° C., preferably higher than or equal to 200° C. and lower than or equal to 500° C. The heat treatment time is longer than or equal to 1 minute and shorter than or equal to 24 hours, preferably longer than or equal to 6 minutes and shorter than or equal to 4 hours. The heat treatment may be performed in an inert atmosphere or an oxidation atmosphere. It is preferable to perform heat treatment in an inert atmosphere and then perform heat treatment in an oxidation atmosphere. The heat treatment in an inert atmosphere can reduce the concentration of impurities in the CAAC-OS film in a short time. At the same time, the heat treatment in an inert atmosphere may generate oxygen vacancies in the CAAC-OS film. In such a case, the heat treatment in an oxidation atmosphere can reduce the oxygen vacancies. The heat treatment can further increase the crystallinity of the CAAC-OS film. Note that the heat treatment may be performed under a reduced pressure, such as 1000 Pa or lower, 100 Pa or lower, 10 Pa or lower, or 1 Pa or lower. The heat treatment under the reduced pressure can reduce the concentration of impurities in the CAAC-OS film in a shorter time.

As an example of the sputtering target, an In—Ga—Zn—O compound target is described below.

The In—Ga—Zn—O compound target, which is polycrystalline, is made by mixing $InO_X$ powder, $GaO_Y$ powder, and $ZnO_Z$ powder in a predetermined molar ratio, applying pressure, and performing heat treatment at a temperature higher than or equal to 1000° C. and lower than or equal to 1500° C. Note that X, Y, and Z are each a given positive number. Here, the predetermined molar ratio of $InO_x$ powder to $GaO_y$ powder and $ZnO_z$ powder is, for example, 1:1:1, 1:1:2, 1:3:2, 1:9:6, 2:1:3, 2:2:1, 3:1:1, 3:1:2, 3:1:4, 4:2:3, 8:4:3, or a ratio close to these ratios. The kinds of powder and the molar ratio for mixing powder may be determined as appropriate depending on the desired sputtering target.

Alternatively, the CAAC-OS film may be formed by the following method.

First, a first oxide semiconductor film is formed to a thickness of greater than or equal to 1 nm and less than 10 nm. The first oxide semiconductor film is formed by a sputtering method. Specifically, the substrate temperature is set to higher than or equal to 100° C. and lower than or equal to 500° C., preferably higher than or equal to 150° C. and lower than or equal to 450° C., and the proportion of oxygen in a deposition gas is set to higher than or equal to 30 vol %, preferably 100 vol %.

Next, heat treatment is performed so that the first oxide semiconductor film becomes a first CAAC-OS film with high crystallinity. The temperature of the heat treatment is higher than or equal to 350° C. and lower than or equal to 740° C., preferably higher than or equal to 450° C. and lower than or equal to 650° C. The heat treatment time is longer than or equal to 1 minute and shorter than or equal to 24 hours, preferably longer than or equal to 6 minutes and shorter than or equal to 4 hours. The heat treatment may be performed in an inert atmosphere or an oxidation atmosphere. It is preferable to perform heat treatment in an inert atmosphere and then perform heat treatment in an oxidation atmosphere. The heat treatment in an inert atmosphere can reduce the concentration of impurities in the first oxide semiconductor film in a short time. At the same time, the heat treatment in an inert atmosphere may generate oxygen vacancies in the first oxide semiconductor film. In such a case, the heat treatment in an oxidation atmosphere can reduce the oxygen vacancies. Note that the heat treatment may be performed under a reduced pressure, such as 1000 Pa or lower, 100 Pa or lower, 10 Pa or lower, or 1 Pa or lower. The heat treatment under the reduced pressure can reduce the concentration of impurities in the first oxide semiconductor film in a shorter time.

The first oxide semiconductor film with a thickness of greater than or equal to 1 nm and less than 10 nm can be easily crystallized by heat treatment as compared to the case where the first oxide semiconductor film has a thickness of greater than or equal to 10 nm.

Next, a second oxide semiconductor film having the same composition as the first oxide semiconductor film is formed to a thickness of greater than or equal to 10 nm and less than or equal to 50 nm. The second oxide semiconductor film is formed by a sputtering method. Specifically, the substrate temperature is set to higher than or equal to 100° C. and lower than or equal to 500° C., preferably higher than or equal to 150° C. and lower than or equal to 450° C., and the proportion of oxygen in a deposition gas is set to higher than or equal to 30 vol %, preferably 100 vol %.

Next, heat treatment is performed so that solid phase growth of the second oxide semiconductor film from the first CAAC-OS film occurs, whereby the second oxide semiconductor film is turned into a second CAAC-OS film having high crystallinity. The temperature of the heat treatment is higher than or equal to 350° C. and lower than or equal to 740° C., preferably higher than or equal to 450° C. and lower than or equal to 650° C. The heat treatment time is longer than or equal to 1 minute and shorter than or equal to 24 hours, preferably longer than or equal to 6 minutes and shorter than or equal to 4 hours. The heat treatment may be performed in an inert atmosphere or an oxidation atmosphere. It is preferable to perform heat treatment in an inert atmosphere and then perform heat treatment in an oxidation atmosphere. The heat treatment in an inert atmosphere can reduce the concentration of impurities in the second oxide semiconductor film in a short time. At the same time, the heat treatment in an inert atmosphere may generate oxygen vacancies in the second oxide semiconductor film. In such a case, the heat treatment in an oxidation atmosphere can reduce the oxygen vacancies. Note that the heat treatment may be performed under a reduced pressure, such as 1000 Pa or lower, 100 Pa or lower, 10 Pa or lower, or 1 Pa or lower. The heat treatment under the reduced pressure can reduce the concentration of impurities in the second oxide semiconductor film in a shorter time.

In the above-described manner, a CAAC-OS film having a total thickness of 10 nm or more can be formed.

Further, the oxide semiconductor film may have a structure in which a plurality of oxide semiconductor films are stacked.

For example, a structure may be employed in which, between an oxide semiconductor film (referred to as a first layer for convenience) and a gate insulating film, a second layer which is formed using the constituent element of the first layer and whose electron affinity is lower than that of the first layer by 0.2 eV or more is provided. In this case, when an electric field is applied from a gate electrode, a channel is formed in the first layer, and a channel is not formed in the second layer. The constituent element of the first layer is the same as the constituent element of the second layer, and thus interface scattering hardly occurs at the interface between the first layer and the second layer. Accordingly, when the second layer is provided between the first layer and the gate insulating film, the field-effect mobility of the transistor can be increased.

Further, in the case where a silicon oxide film, a silicon oxynitride film, a silicon nitride oxide film, or a silicon nitride film is used as the gate insulating film, silicon contained in the gate insulating film enters the oxide semiconductor film in some cases. When the oxide semiconductor film contains silicon, reductions in crystallinity and carrier mobility of the oxide semiconductor film occur, for example. Thus, it is preferable to provide the second layer between the first layer and the gate insulating film in order to reduce the concentration of silicon in the first layer where a channel is formed. For the same reason, it is preferable to provide a third layer which is formed using the constituent element of the first layer and whose electron affinity is lower than that of the first layer by 0.2 eV or more so that the first layer is interposed between the second layer and the third layer.

Such a structure makes it possible to reduce and further prevent diffusion of impurities such as silicon to a region where a channel is formed, so that a highly reliable transistor can be obtained.

Note that in order to make the oxide semiconductor film a CAAC-OS film, the concentration of silicon contained in the oxide semiconductor film is set to lower than or equal to $2.5\times10^{21}/cm^3$, preferably lower than $1.4\times10^{21}/cm^3$, further preferably lower than $4\times10^{19}/cm^3$, still further preferably lower than $2.0\times10^{18}/cm^3$. This is because the field-effect mobility of the transistor may be reduced when the concentration of silicon contained in the oxide semiconductor film is higher than or equal to $1.4\times10^{21}/cm^3$, and the oxide semiconductor film may be made amorphous at the interface between the oxide semiconductor film and a film in contact with the oxide semiconductor film when the concentration of silicon contained in the oxide semiconductor film is higher than or equal to $4.0\times10^{19}/cm^3$. Further, when the concentration of silicon contained in the oxide semiconductor film is lower than $2.0\times10^{18}/cm^3$, further improvement in reliability of the transistor and a reduction in density of states (DOS) in the oxide semiconductor film can be expected. Note that the concentration of silicon in the oxide semiconductor film can be measured by secondary ion mass spectrometry (SIMS).

The semiconductor and the semiconductor film described in this embodiment can be applied to a transistor provided in a display portion of a display unit included in the information processing device of one embodiment of the present invention. Thus, the semiconductor device having a display function described in this embodiment can reduce users' eye strain and perform eye-friendly display by employing the driving method of an information processing device described in Embodiment 1 and making the arithmetic unit execute a program for driving the information processing device as described in Embodiment 1.

This embodiment can be combined with any of the other embodiments disclosed in this specification as appropriate.

Embodiment 7

In this embodiment, structural examples of a transistor including the oxide semiconductor film described in Embodiment 6 are described with reference to drawings.

<Structural Example of Transistor>

Figure 18A:
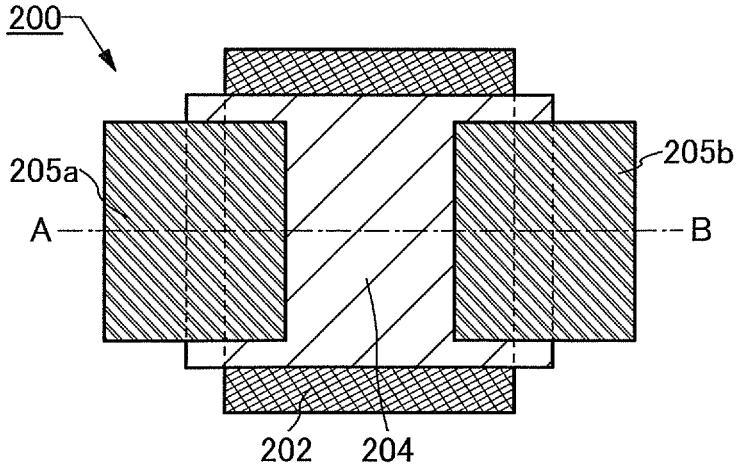
FIGS. 18A and 18B illustrate a structural example of a transistor.
Figure 18B:
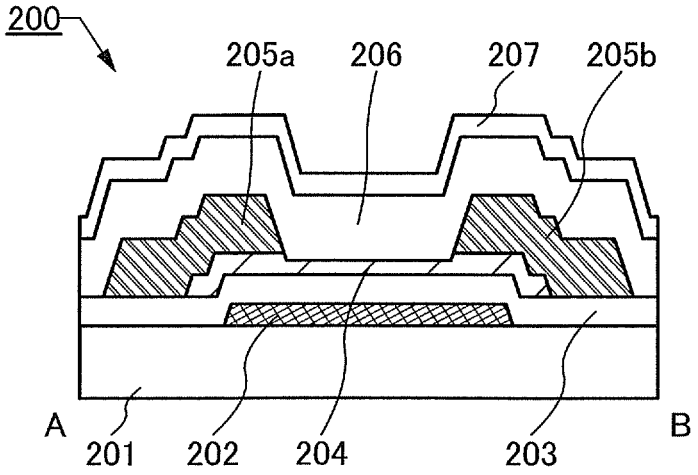

FIG. 18A is a schematic top view of a transistor 200 described below as an example. FIG. 18B is a schematic cross-sectional view of the transistor 200 taken along the section line A-B in FIG. 18A. The transistor 200 described as an example in this structural example is a bottom-gate transistor.

The transistor 200 includes a gate electrode 202 over a substrate 201, an insulating layer 203 over the substrate 201 and the gate electrode 202, an oxide semiconductor layer 204 over the insulating layer 203, which overlaps with the gate electrode 202, and a pair of electrodes 205*a* and 205*b* in contact with the top surface of the oxide semiconductor layer 204. Further, an insulating layer 206 is provided to cover the insulating layer 203, the oxide semiconductor layer 204, and the pair of electrodes 205*a* and 205*b*, and an insulating layer 207 is provided over the insulating layer 206.

The oxide semiconductor film described in Embodiment 6 can be used for the oxide semiconductor layer 204 of the transistor 200.

[Substrate 201]

There is no particular limitation on the property of a material and the like of the substrate 201 as long as the material has heat resistance enough to withstand at least heat treatment which is performed later. For example, a glass substrate, a ceramic substrate, a quartz substrate, a sapphire substrate, or an yttria-stabilized zirconia (YSZ) substrate may be used as the substrate 201. Alternatively, a single crystal semiconductor substrate or a polycrystalline semiconductor substrate made of silicon, silicon carbide, or the like, a compound semiconductor substrate made of silicon germanium or the like, an SOI substrate, or the like can be used as the substrate 201. Still alternatively, any of these substrates provided with a semiconductor element may be used as the substrate 201.

Still alternatively, a flexible substrate such as a plastic substrate may be used as the substrate 201, and the transistor 200 may be provided directly on the flexible substrate. Further alternatively, a separation layer may be provided between the substrate 201 and the transistor 200. The separation layer can be used when part or the whole of the transistor formed over the separation layer is formed and separated from the substrate 201 and transferred to another substrate. Thus, the transistor 200 can be transferred to a substrate having low heat resistance or a flexible substrate.

[Gate Electrode 202]

The gate electrode 202 can be formed using a metal selected from aluminum, chromium, copper, tantalum, titanium, molybdenum, and tungsten; an alloy containing any of these metals as a component; an alloy containing any of these metals in combination; or the like. Further, one or more metals selected from manganese and zirconium may be used. Furthermore, the gate electrode 202 may have a single-layer structure or a stacked-layer structure of two or more layers. For example, a single-layer structure of an aluminum film containing silicon, a two-layer structure in which a titanium film is stacked over an aluminum film, a two-layer structure in which a titanium film is stacked over a titanium nitride film, a two-layer structure in which a tungsten film is stacked over a titanium nitride film, a two-layer structure in which a tungsten film is stacked over a tantalum nitride film or a tungsten nitride film, a three-layer structure in which a titanium film, an aluminum film, and a titanium film are stacked in this order, and the like can be given. Alternatively, an alloy film containing aluminum and one or more metals selected from titanium, tantalum, tungsten, molybdenum, chromium, neodymium, and scandium; or a nitride film of the alloy film may be used.

The gate electrode 202 can also be formed using a light-transmitting conductive material such as indium tin oxide, indium oxide containing tungsten oxide, indium zinc oxide containing tungsten oxide, indium oxide containing titanium oxide, indium tin oxide containing titanium oxide, indium zinc oxide, or indium tin oxide to which silicon oxide is added. It is also possible to have a stacked-layer structure formed using the above light-transmitting conductive material and the above metal.

Further, an In—Ga—Zn-based oxynitride semiconductor film, an In—Sn-based oxynitride semiconductor film, an In—Ga-based oxynitride semiconductor film, an In—Zn-based oxynitride semiconductor film, a Sn-based oxynitride semiconductor film, an In-based oxynitride semiconductor film, a film of metal nitride (such as InN or ZnN), or the like may be provided between the gate electrode 202 and the insulating layer 203. These films each have a work function higher than or equal to 5 eV, preferably higher than or equal to 5.5 eV, which is higher than the electron affinity of the oxide semiconductor. Thus, the threshold voltage of the transistor including an oxide semiconductor can be shifted in the positive direction, and what is called a normally-off switching element can be achieved. For example, in the case of using an In—Ga—Zn-based oxynitride semiconductor film, an In—Ga—Zn-based oxynitride semiconductor film having a higher nitrogen concentration than at least the oxide semiconductor layer 204, specifically, an In—Ga—Zn-based oxynitride semiconductor film having a nitrogen concentration of 7 at. % or higher is used.

[Insulating Layer 203]

The insulating layer 203 functions as a gate insulating film. The insulating layer 203 in contact with the bottom surface of the oxide semiconductor layer 204 is preferably an amorphous film.

The insulating layer 203 may be formed to have a single-layer structure or a stacked-layer structure using, for example, one or more of silicon oxide, silicon oxynitride, silicon nitride oxide, silicon nitride, aluminum oxide, hafnium oxide, gallium oxide, Ga—Zn-based metal oxide, silicon nitride, and the like.

The insulating layer 203 may be formed using a high-k material such as hafnium silicate ($HfSi_xO_y$), hafnium silicate ($HfSi_xO_y$) to which nitrogen is added, hafnium aluminate ($HfAl_xO_y$) to which nitrogen is added, hafnium oxide, or yttrium oxide, so that gate leakage current of the transistor can be reduced.

[Pair of Electrodes 205*a* and 205*b*]

The pair of electrodes 205*a* and 205*b* functions as a source electrode and a drain electrode of the transistor.

The pair of electrodes 205*a* and 205*b* can be formed to have a single-layer structure or a stacked-layer structure using, as a conductive material, any of metals such as aluminum, titanium, chromium, nickel, copper, yttrium, zirconium, molybdenum, silver, tantalum, and tungsten, or an alloy containing any of these metals as its main component. For example, a single-layer structure of an aluminum film containing silicon, a two-layer structure in which a titanium film is stacked over an aluminum film, a two-layer structure in which a titanium film is stacked over a tungsten film, a two-layer structure in which a copper film is stacked over a copper-magnesium-aluminum alloy film, a three-layer structure in which a titanium film or a titanium nitride film, an aluminum film or a copper film, and a titanium film or a titanium nitride film are stacked in this order, a three-layer structure in which a molybdenum film or a molybdenum nitride film, an aluminum film or a copper film, and a molybdenum film or a molybdenum nitride film are stacked in this order, and the like can be given. Note that a transparent conductive material containing indium oxide, tin oxide, or zinc oxide may be used.

[Insulating Layers 206 and 207]

The insulating layer 206 is preferably formed using an oxide insulating film containing oxygen at a higher proportion than oxygen in the stoichiometric composition. Part of oxygen is released by heating from the oxide insulating film containing oxygen at a higher proportion than oxygen in the stoichiometric composition. The oxide insulating film containing oxygen at a higher proportion than oxygen in the stoichiometric composition is an oxide insulating film in which the amount of released oxygen converted into oxygen atoms is greater than or equal to $1.0\times10^{18}$ atoms/cm$^3$, preferably greater than or equal to $3.0\times10^{20}$ atoms/cm$^3$ in thermal desorption spectroscopy (TDS) analysis.

As the insulating layer 206, a silicon oxide film, a silicon oxynitride film, or the like can be formed.

Note that the insulating layer 206 also functions as a film which relieves damage to the oxide semiconductor layer 204 at the time of forming the insulating layer 207 later.

Alternatively, an oxide film transmitting oxygen may be provided between the insulating layer 206 and the oxide semiconductor layer 204.

As the oxide film transmitting oxygen, a silicon oxide film, a silicon oxynitride film, or the like can be formed. Note that in this specification, a "silicon oxynitride film" refers to a film that contains oxygen at a higher proportion than nitrogen, and a "silicon nitride oxide film" refers to a film that contains nitrogen at a higher proportion than oxygen.

The insulating layer 207 can be formed using an insulating film having a blocking effect against oxygen, hydrogen, water, and the like. It is possible to prevent outward diffusion of oxygen from the oxide semiconductor layer 204 and entry of hydrogen, water, or the like into the oxide semiconductor layer 204 from the outside by providing the insulating layer 207 over the insulating layer 206. As for the insulating film having a blocking effect against oxygen, hydrogen, water, and the like, a silicon nitride film, a silicon nitride oxide film, an aluminum oxide film, an aluminum oxynitride film, a gallium oxide film, a gallium oxynitride film, an yttrium oxide film, an yttrium oxynitride film, a hafnium oxide film, and a hafnium oxynitride film can be given as examples.

<Example of Manufacturing Method of Transistor>

Next, an example of a manufacturing method of the transistor 200 illustrated in FIGS. 18A and 18B is described.

Figure 19A:
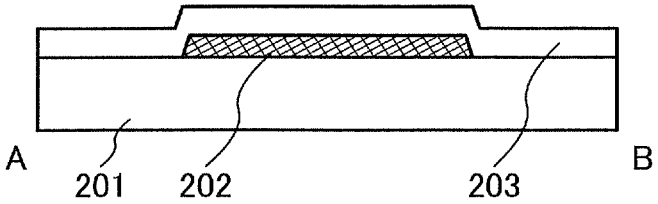
FIGS. 19A to 19D illustrate an example of a method for manufacturing a transistor.

First, as illustrated in FIG. 19A, the gate electrode 202 is formed over the substrate 201, and the insulating layer 203 is formed over the gate electrode 202.

Here, a glass substrate is used as the substrate 201.

[Formation of Gate Electrode]

A formation method of the gate electrode 202 is described below. First, a conductive film is formed by a sputtering method, a CVD method, an evaporation method, or the like and then a resist mask is formed over the conductive film using a first photomask by a photolithography process. Then, part of the conductive film is etched using the resist mask to form the gate electrode 202. After that, the resist mask is removed.

Note that instead of the above formation method, the gate electrode 202 may be formed by an electrolytic plating method, a printing method, an ink-jet method, or the like.

[Formation of Gate Insulating Layer]

The insulating layer 203 is formed by a sputtering method, a CVD method, an evaporation method, or the like.

In the case where the insulating layer 203 is formed using a silicon oxide film, a silicon oxynitride film, or a silicon nitride oxide film, a deposition gas containing silicon and an oxidizing gas are preferably used as a source gas. Typical examples of the deposition gas containing silicon include silane, disilane, trisilane, and silane fluoride. As the oxidizing gas, oxygen, ozone, dinitrogen monoxide, and nitrogen dioxide can be given as examples.

In the case of forming a silicon nitride film as the insulating layer 203, it is preferable to use a two-step formation method. First, a first silicon nitride film with a small number of defects is formed by a plasma CVD method in which a mixed gas of silane, nitrogen, and ammonia is used as a source gas. Then, a second silicon nitride film in which the hydrogen concentration is low and hydrogen can be blocked is formed by switching the source gas to a mixed gas of silane and nitrogen. With such a formation method, a silicon nitride film with a small number of defects and a blocking property against hydrogen can be formed as the insulating layer 203.

Moreover, in the case of forming a gallium oxide film as the insulating layer 203, a metal organic chemical vapor deposition (MOCVD) method can be employed.

[Formation of Oxide Semiconductor Layer]

Figure 19B:
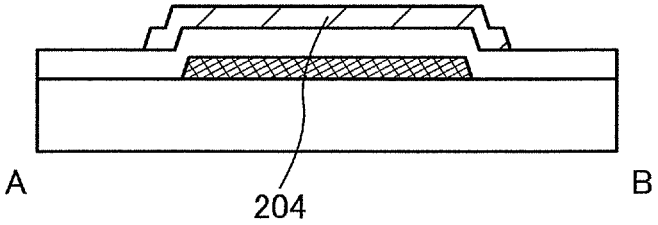

Next, as illustrated in FIG. 19B, the oxide semiconductor layer 204 is formed over the insulating layer 203.

A formation method of the oxide semiconductor layer 204 is described below. First, an oxide semiconductor film is formed by the method described in Embodiment 6. Then, a resist mask is formed over the oxide semiconductor film using a second photomask by a photolithography process. Then, part of the oxide semiconductor film is etched using the resist mask to form the oxide semiconductor layer 204. After that, the resist mask is removed.

After that, heat treatment may be performed. In such a case, the heat treatment is preferably performed under an atmosphere containing oxygen.

[Formation of Pair of Electrodes]

Figure 19C:
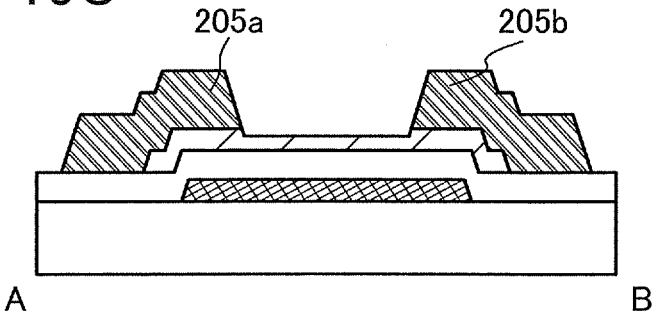

Next, as illustrated in FIG. 19C, the pair of electrodes 205*a* and 205*b* is formed.

A formation method of the pair of electrodes 205*a* and 205*b* is described below. First, a conductive film is formed by a sputtering method, a CVD method, an evaporation method, or the like. Then, a resist mask is formed over the conductive film using a third photomask by a photolithography process. Then, part of the conductive film is etched using the resist mask to form the pair of electrodes 205*a* and 205*b*. After that, the resist mask is removed.

Note that as illustrated in FIG. 19C, an upper part of the oxide semiconductor layer 204 is in some cases partly etched and thinned by the etching of the conductive film. For this reason, the oxide semiconductor layer 204 is preferably formed thick.

[Formation of Insulating Layer]

Figure 19D:
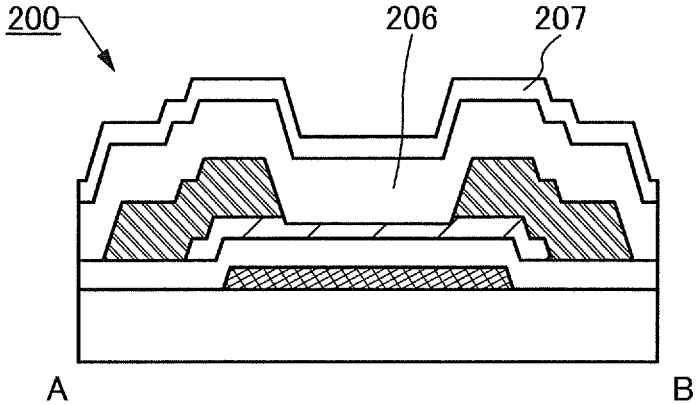

Next, as illustrated in FIG. 19D, the insulating layer 206 is formed over the oxide semiconductor layer 204 and the pair of electrodes 205*a* and 205*b*, and the insulating layer 207 is successively formed over the insulating layer 206.

In the case where the insulating layer 206 is formed using a silicon oxide film or a silicon oxynitride film, a deposition gas containing silicon and an oxidizing gas are preferably used as a source gas. Typical examples of the deposition gas containing silicon include silane, disilane, trisilane, and silane fluoride. As the oxidizing gas, oxygen, ozone, dinitrogen monoxide, and nitrogen dioxide can be given as examples.

For example, a silicon oxide film or a silicon oxynitride film is formed under the conditions as follows: the substrate placed in a treatment chamber of a plasma CVD apparatus, which is vacuum-evacuated, is held at a temperature higher than or equal to 180° C. and lower than or equal to 260° C., preferably higher than or equal to 200° C. and lower than or equal to 240° C., the pressure is greater than or equal to 100 Pa and less than or equal to 250 Pa, preferably greater than or equal to 100 Pa and less than or equal to 200 Pa with introduction of a source gas into the treatment chamber, and high-frequency power higher than or equal to 0.17 W/cm$^2$ and lower than or equal to 0.5 W/cm$^2$, preferably higher than or equal to 0.25 W/cm$^2$ and lower than or equal to 0.35 W/cm$^2$ is supplied to an electrode provided in the treatment chamber.

As the film formation conditions, the high-frequency power having the above power density is supplied to the treatment chamber having the above pressure, whereby the decomposition efficiency of the source gas in plasma is increased, oxygen radicals are increased, and oxidation of the source gas is promoted; therefore, oxygen is contained in the oxide insulating film at a higher proportion than oxygen in the stoichiometric composition. However, in the case where the substrate temperature is within the above temperature range, the bond between silicon and oxygen is weak, and accordingly, part of oxygen is released by heating. Thus, it is possible to form an oxide insulating film which contains oxygen at a higher proportion than oxygen in the stoichiometric composition and from which part of oxygen is released by heating.

Further, in the case of providing an oxide insulating film between the oxide semiconductor layer 204 and the insulating layer 206, the oxide insulating film serves as a protective film for the oxide semiconductor layer 204 in the steps of forming the insulating layer 206. Thus, the insulating layer 206 can be formed using the high-frequency power having a high power density while damage to the oxide semiconductor layer 204 is reduced.

For example, a silicon oxide film or a silicon oxynitride film is formed as the oxide insulating film under the conditions as follows: the substrate placed in a treatment chamber of a plasma CVD apparatus, which is vacuum-evacuated, is held at a temperature higher than or equal to 180° C. and lower than or equal to 400° C., preferably higher than or equal to 200° C. and lower than or equal to 370° C., the pressure is greater than or equal to 20 Pa and less than or equal to 250 Pa, preferably greater than or equal to 100 Pa and less than or equal to 250 Pa with introduction of a source gas into the treatment chamber, and high-frequency power is supplied to an electrode provided in the treatment chamber. Further, when the pressure in the treatment chamber is greater than or equal to 100 Pa and less than or equal to 250 Pa, damage to the oxide semiconductor layer 204 can be reduced.

A deposition gas containing silicon and an oxidizing gas are preferably used as a source gas of the oxide insulating film. Typical examples of the deposition gas containing silicon include silane, disilane, trisilane, and silane fluoride. As the oxidizing gas, oxygen, ozone, dinitrogen monoxide, and nitrogen dioxide can be given as examples.

The insulating layer 207 can be formed by a sputtering method, a CVD method, or the like.

In the case where the insulating layer 207 is formed using a silicon nitride film or a silicon nitride oxide film, a deposition gas containing silicon, an oxidizing gas, and a gas containing nitrogen are preferably used as a source gas. Typical examples of the deposition gas containing silicon include silane, disilane, trisilane, and silane fluoride. As the oxidizing gas, oxygen, ozone, dinitrogen monoxide, and nitrogen dioxide can be given as examples. As the gas containing nitrogen, nitrogen and ammonia can be given as examples.

Through the above process, the transistor 200 can be formed.

<Modification Example of Transistor 200>

A structural example of a transistor, which is partly different from the transistor 200, is described below.

Modification Example 1

Figure 20A:
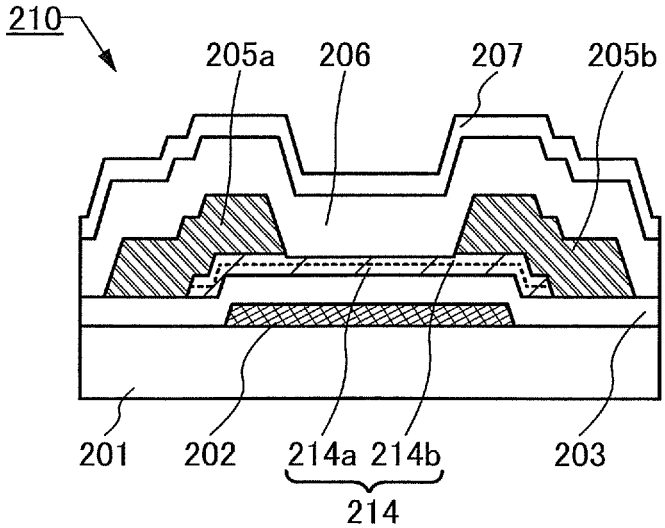
FIGS. 20A and 20B each illustrate a structural example of a transistor.

FIG. 20A is a schematic cross-sectional view of a transistor 210 described as an example below. The transistor 210 is different from the transistor 200 in the structure of an oxide semiconductor layer.

In an oxide semiconductor layer 214 included in the transistor 210, an oxide semiconductor layer 214*a* and an oxide semiconductor layer 214*b* are stacked.

Since a boundary between the oxide semiconductor layer 214*a* and the oxide semiconductor layer 214*b* is unclear in some cases, the boundary is shown by a dashed line in FIG. 20A and the like.

The oxide semiconductor film of one embodiment of the present invention can be applied to one or both of the oxide semiconductor layers 214*a* and 214*b*.

Typical examples of a material that can be used for the oxide semiconductor layer 214*a* are an In—Ga oxide, an In—Zn oxide, and an In-M-Zn oxide (M is Al, Ti, Ga, Y, Zr, La, Ce, Nd, or Hf). When an In-M-Zn oxide is used for the oxide semiconductor layer 214*a*, the proportions of In and M when summation of In and M is assumed to be 100 atomic % is preferably as follows: the atomic percentage of In is less than 50 at. % and the atomic percentage of M is greater than or equal to 50 at. %; further preferably, the atomic percentage of In is less than 25 at. % and the atomic percentage of M is greater than or equal to 75 at. %. Further, a material having an energy gap of 2 eV or more, preferably 2.5 eV or more, further preferably 3 eV or more is used for the oxide semiconductor layer 214*a*, for example.

For example, the oxide semiconductor layer 214*b* contains In or Ga; the oxide semiconductor layer 214*b* contains, for example, a material typified by an In—Ga oxide, an In—Zn oxide, or an In-M-Zn oxide (M is Al, Ti, Ga, Y, Zr, La, Ce, Nd, or Hf). In addition, the energy of the conduction band minimum of the oxide semiconductor layer 214*b* is closer to the vacuum level than that of the oxide semiconductor layer 214*a* is. The difference between the energy of the conduction band minimum of the oxide semiconductor layer 214*b* and the energy of the conduction band minimum of the oxide semiconductor layer 214*a* is preferably 0.05 eV or more, 0.07 eV or more, 0.1 eV or more, or 0.15 eV or more and 2 eV or less, 1 eV or less, 0.5 eV or less, or 0.4 eV or less.

When an In-M-Zn oxide is used for the oxide semiconductor layer 214*b*, for example, the proportions of In and M when summation of In and M is assumed to be 100 atomic % is preferably as follows: the atomic percentage of In is greater than or equal to 25 at. % and the atomic percentage of M is less than 75 at. %; further preferably, the atomic percentage of In is greater than or equal to 34 at. % and the atomic percentage of M is less than 66 at. %.

For the oxide semiconductor layer 214*a*, an In—Ga—Zn oxide containing In, Ga, and Zn at an atomic ratio of 1:1:1 or 3:1:2 can be used, for example. Further, for the oxide semiconductor layer 214*b*, an In—Ga—Zn oxide containing In, Ga, and Zn at an atomic ratio of 1:3:2, 1:6:4, or 1:9:6 can be used. Note that the atomic ratio of each of the oxide semiconductor layers 214*a* and 214*b* varies within a range of ±20% of the above atomic ratio as an error.

When an oxide containing a large amount of Ga that serves as a stabilizer is used for the oxide semiconductor layer 214*b* provided over the oxide semiconductor layer 214*a*, oxygen can be prevented from being released from the oxide semiconductor layers 214*a* and 214*b*.

Note that, without limitation to those described above, a material with an appropriate composition may be used depending on required semiconductor characteristics and electrical characteristics (e.g., field-effect mobility and threshold voltage) of a transistor. Further, in order to obtain required semiconductor characteristics of a transistor, it is preferable that the carrier density, the impurity concentration, the defect density, the atomic ratio of a metal element to oxygen, the interatomic distance, the density, and the like of the oxide semiconductor layers 214*a* and 214*b* be set to be appropriate.

Although a structure in which two oxide semiconductor layers are stacked is described above as an example of the oxide semiconductor layer 214, a structure in which three or more oxide semiconductor layers are stacked can also be employed.

Modification Example 2

Figure 20B:
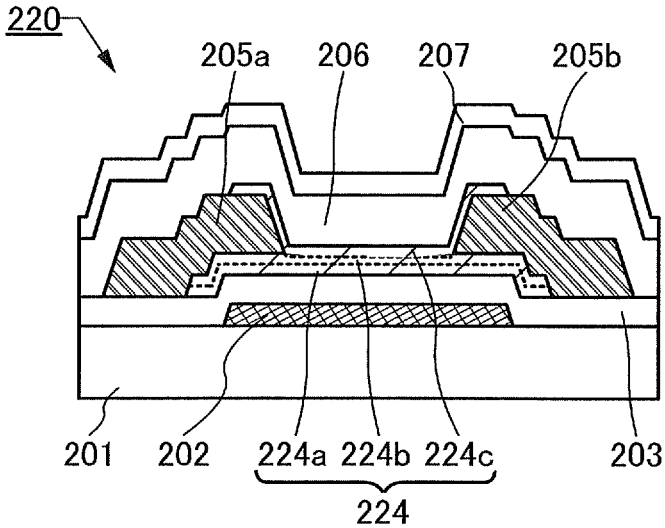

FIG. 20B is a schematic cross-sectional view of a transistor 220 described as an example below. The transistor 220 is different from the transistor 200 and the transistor 210 in the structure of an oxide semiconductor layer.

In an oxide semiconductor layer 224 included in the transistor 220, an oxide semiconductor layer 224*a*, an oxide semiconductor layer 224*b*, and an oxide semiconductor layer 224*c* are stacked in this order.

The oxide semiconductor layers 224*a* and 224*b* are stacked over the insulating layer 203. The oxide semiconductor layer 224*c* is provided in contact with the top surface of the oxide semiconductor layer 224*b* and the top surfaces and side surfaces of the pair of electrodes 205*a* and 205*b*.

The oxide semiconductor film described in Embodiment 6 can be applied to one or more of the oxide semiconductor layer 224*a*, the oxide semiconductor layer 224*b*, and the oxide semiconductor layer 224*c*.

The oxide semiconductor layer 224*b* can have a structure which is similar to that of the oxide semiconductor layer 214*a* described as an example in Modification Example 1, for example. Further, the oxide semiconductor layers 224*a* and 224*c* can each have a structure which is similar to that of the oxide semiconductor layer 214*b* described as an example in Modification Example 1, for example.

When an oxide containing a large amount of Ga that serves as a stabilizer is used for the oxide semiconductor layer 224*a*, which is provided under the oxide semiconductor layer 224*b*, and the oxide semiconductor layer 224*c*, which is provided over the oxide semiconductor layer 224*b*, for example, oxygen can be prevented from being released from the oxide semiconductor layer 224*a*, the oxide semiconductor layer 224*b*, and the oxide semiconductor layer 224*c*.

In the case where a channel is mainly formed in the oxide semiconductor layer 224*b*, for example, an oxide containing a large amount of In can be used for the oxide semiconductor layer 224*b* and the pair of electrodes 205*a* and 205*b* is provided in contact with the oxide semiconductor layer 224*b*; thus, the on-state current of the transistor 220 can be increased.

<Another Structural example of Transistor>

A structural example of a top-gate transistor to which the oxide semiconductor film of one embodiment of the present invention can be applied is described below.

Note that descriptions of components having structures or functions similar to those of the above, which are denoted by the same reference numerals, are omitted below.

[Structural Example]

Figure 21A:
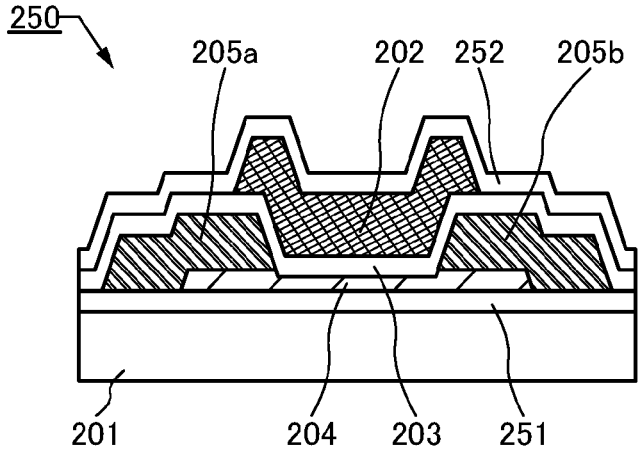
FIGS. 21A to 21C each illustrate a structural example of a transistor.

FIG. 21A is a schematic cross-sectional view of a top-gate transistor 250 which is described below as an example.

The transistor 250 includes the oxide semiconductor layer 204 over the substrate 201 on which an insulating layer 251 is provided, the pair of electrodes 205*a* and 205*b* in contact with the top surface of the oxide semiconductor layer 204, the insulating layer 203 over the oxide semiconductor layer 204 and the pair of electrodes 205*a* and 205*b*, and the gate electrode 202 provided over the insulating layer 203 so as to overlap with the oxide semiconductor layer 204. Further, an insulating layer 252 is provided to cover the insulating layer 203 and the gate electrode 202.

The oxide semiconductor film described in Embodiment 6 can be used for the oxide semiconductor layer 204 of the transistor 250.

The insulating layer 251 has a function of suppressing diffusion of impurities from the substrate 201 into the oxide semiconductor layer 204. For example, a structure similar to that of the insulating layer 207 can be employed. Note that the insulating layer 251 is not necessarily provided.

The insulating layer 252 can be formed using an insulating film having a blocking effect against oxygen, hydrogen, water, and the like in a manner similar to that of the insulating layer 207. Note that the insulating layer 207 is not necessarily provided.

Modification Example

A structural example of a transistor, which is partly different from the transistor 250, is described below.

Figure 21B:
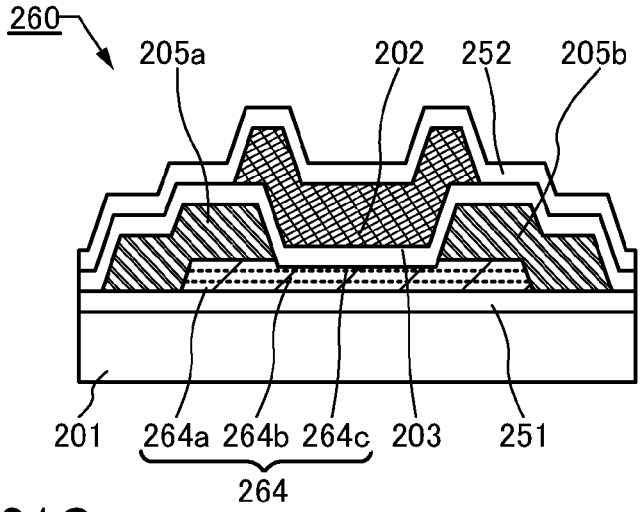

FIG. 21B is a schematic cross-sectional view of a transistor 260 described as an example below. The structure of an oxide semiconductor layer in the transistor 260 is different from that in the transistor 250.

In an oxide semiconductor layer 264 included in the transistor 260, an oxide semiconductor layer 264*a*, an oxide semiconductor layer 264*b*, and an oxide semiconductor layer 264*c* are stacked in this order.

The oxide semiconductor film described in Embodiment 6 can be applied to one or more of the oxide semiconductor layer 264*a*, the oxide semiconductor layer 264*b*, and the oxide semiconductor layer 264*c*.

The oxide semiconductor layer 264*b* can have a structure which is similar to that of the oxide semiconductor layer 214*a* described as an example in Modification Example 1, for example. Further, the oxide semiconductor layers 264*a* and 264*c* can each have a structure which is similar to that of the oxide semiconductor layer 214*b* described as an example in Modification Example 1, for example.

An oxide containing a large amount of Ga that serves as a stabilizer is used for the oxide semiconductor layer 264*a*, which is provided under the oxide semiconductor layer 264*b*, and the oxide semiconductor layer 264*c*, which is provided over the oxide semiconductor layer 264*b*, for example; thus, oxygen can be prevented from being released from the oxide semiconductor layer 264*a*, the oxide semiconductor layer 264*b*, and the oxide semiconductor layer 264*c*.

The oxide semiconductor layer 264 can be formed in the following manner: the oxide semiconductor layer 264*c* and the oxide semiconductor layer 264*b* are obtained by etching, so that an oxide semiconductor film to be the oxide semiconductor layer 264*a* is exposed; and the oxide semiconductor film is processed into the oxide semiconductor layer 264*a* by a dry etching method. In that case, a reaction product of the oxide semiconductor film is attached to side surfaces of the oxide semiconductor layers 264*b* and 264*c* to form a sidewall protective layer (also referred to as a rabbit ear) in some cases. Note that the reaction product may be attached by a sputtering phenomenon or through plasma at the time of the dry etching.

Figure 21C:
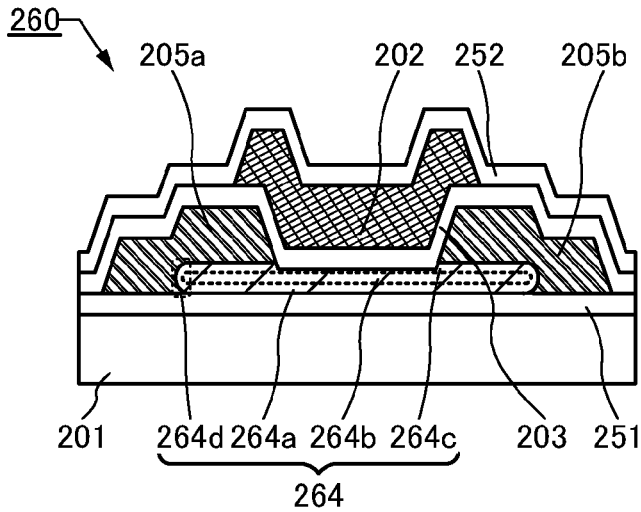

FIG. 21C is a schematic cross-sectional view of a transistor 260 in which a sidewall protective layer 264*d* is formed as a side surface of the oxide semiconductor layer 264 in the above manner.

The sidewall protective layer 264*d* mainly contains the same material as the oxide semiconductor layer 264*a*. In some cases, the sidewall protective layer 264*d* contains the constituent (e.g., silicon) of a layer provided under the oxide semiconductor layer 264*a* (the insulating layer 251 here).

With a structure in which a side surface of the oxide semiconductor layer 264*b* is covered with the sidewall protective layer 264*d* so as not to be in contact with the pair of electrodes 205*a* and 205*b* as illustrated in FIG. 21C, unintended leakage current of the transistor in an off state can be reduced particularly when a channel is mainly formed in the oxide semiconductor layer 264*b*; thus, a transistor having favorable off-state characteristics can be fabricated. Further, when a material containing a large amount of Ga that serves as a stabilizer is used for the sidewall protective layer 264*d*, oxygen can be effectively prevented from being released from the side surface of the oxide semiconductor layer 264*b*; thus, a transistor having excellent stability of electrical characteristics can be fabricated.

The transistor described in this embodiment can be applied on a display portion of a display unit included in the information processing device of one embodiment of the present invention. Thus, the semiconductor device having a display function described in this embodiment can reduce users' eye strain and perform eye-friendly display by employing the driving method of an information processing device described in Embodiment 1 and making the arithmetic unit execute a program for driving the information processing device as described in Embodiment 1.

This embodiment can be combined with any of the other embodiments in this specification as appropriate.

Embodiment 8

In this embodiment, examples of an information processing device of one embodiment of the present invention are described with reference to FIGS. 22A to 22F.

Figure 22A:
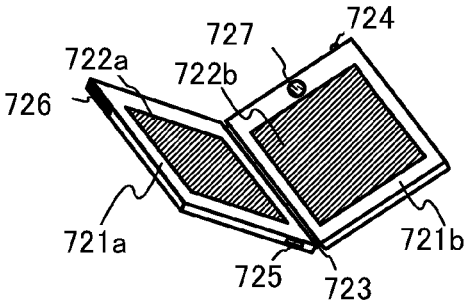
FIGS. 22A to 22F each illustrate an example of an information processing device.

An information processing device illustrated in FIG. 22A is an example of a foldable information terminal.

The information processing device in FIG. 22A includes a housing 721*a*, a housing 721*b*, a panel 722*a* incorporated in the housing 721*a*, a panel 722*b* incorporated in the housing 721*b*, a hinge 723, a button 724, a connection terminal 725, a storage medium insertion portion 726, and a speaker 727.

The housing 721*a* and the housing 721*b* are connected by the hinge 723.

Since the information processing device in FIG. 22A includes the hinge 723, it can be folded so that the panels 722*a* and 722*b* face each other.

The button 724 is provided on the housing 721*b*. Note that the button 724 may be provided on the housing 721*a*. For example, when the button 724 having a function as a power button is provided, supply of power supply voltage to the information processing device can be controlled by pressing the button 724.

The connection terminal 725 is provided on the housing 721*a*. Note that the connection terminal 725 may be provided on the housing 721*b*. Alternatively, a plurality of connection terminals 725 may be provided on one or both of the housings 721*a* and 721*b*. The connection terminal 725 is a terminal for connecting the information processing device illustrated in FIG. 22A to another device.

The storage medium insertion portion 726 is provided on the housing 721*a*. The storage medium insertion portion 726 may be provided on the housing 721*b*. Alternatively, a plurality of storage medium insertion portions 726 may be provided on one or both of the housings 721*a* and 721*b*. For example, a card storage medium is inserted into the storage medium insertion portion so that data can be read to the information processing device from the card storage medium or data stored in the information processing device can be written into the card storage medium.

The speaker 727 is provided on the housing 721*b*. The speaker 727 outputs sound. Note that the speaker 727 may be provided on the housing 721*a*.

Note that the housing 721*a* or the housing 721*b* may be provided with a microphone, in which case the information processing device in FIG. 22A can function as a telephone, for example.

The information processing device illustrated in FIG. 22A functions as one or more of a telephone set, an e-book reader, a personal computer, and a game machine, for example, and can be driven by the method described in any of the above embodiments.

Figure 22B:
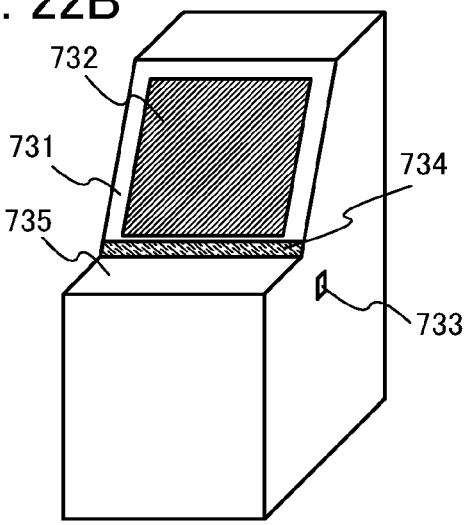

An information processing device illustrated in FIG. 22B is an example of a stationary information terminal. The information processing device in FIG. 22B includes a housing 731, a panel 732 incorporated in the housing 731, a button 733, and a speaker 734.

Note that a panel similar to the panel 732 may be provided on a top board 735 of the housing 731.

Further, the housing 731 may be provided with a ticket slot for issuing a ticket or the like, a coin slot, a bill slot, and/or the like.

The button 733 is provided on the housing 731. For example, when the button 733 is a power button, supply of power supply voltage to the information processing device can be controlled by pressing the button 733.

The speaker 734 is provided on the housing 731. The speaker 734 outputs sound.

The information processing device in FIG. 22B serves as an automated teller machine, an information communication terminal (also referred to as multimedia station) for ordering a ticket or the like, or a game machine, for example, and can be driven by the method described in any of the above embodiments.

Figure 22C:
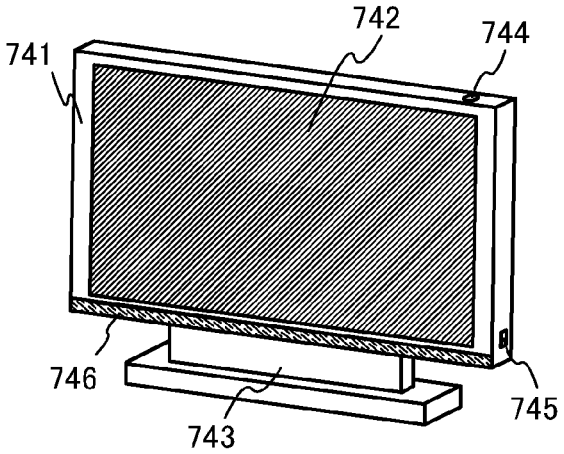

FIG. 22C illustrates an example of a stationary information terminal. The information processing device in FIG. 22C includes a housing 741, a panel 742 incorporated in the housing 741, a support 743 for supporting the housing 741, a button 744, a connection terminal 745, and a speaker 746.

Note that the housing 741 may be provided with another connection terminal for connecting the information processing device to an external device.

The button 744 is provided on the housing 741. For example, when the button 744 is a power button, supply of power supply voltage to the information processing device can be controlled by pressing the button 744.

The connection terminal 745 is provided on the housing 741. The connection terminal 745 is a terminal for connecting the information processing device in FIG. 22C to another device. For example, when the information processing device in FIG. 22C and a personal computer are connected with the connection terminal 745, the panel 742 can display an image corresponding to a data signal input from the personal computer. For example, when the panel 742 of the information processing device in FIG. 22C is larger than a panel of another information processing device connected thereto, a displayed image of the other information processing device can be enlarged, so that a plurality of viewers can easily see the image at the same time.

The speaker 746 is provided on the housing 741. The speaker 746 outputs sound.

The information processing device in FIG. 22C functions as at least one of an output monitor, a personal computer, and a television set, for example, and can be driven by the method described in any of the above embodiments.

Figure 22D:
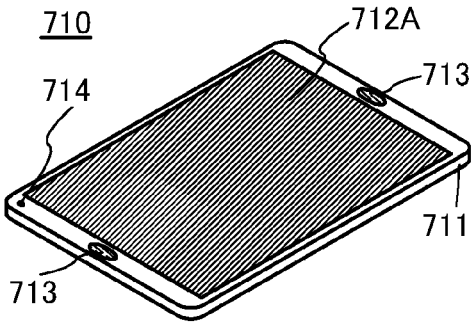
Figure 22E:
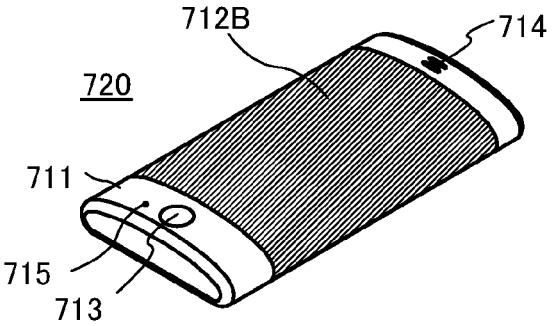

Information processing devices illustrated in FIGS. 22D and 22E are examples of portable information terminals.

A portable information terminal 710 in FIG. 22D includes a panel 712A incorporated in a housing 711, an operation button 713, and a speaker 714. Further, although not shown, the portable information terminal 710 includes a microphone, a stereo headphone jack, a memory card insertion slot, a camera, an external connection port such as a USB connector, and the like.

The portable information terminal 710 in FIG. 22D can be driven by the method described in any of the above embodiments.

A portable information terminal 720 illustrated in FIG. 22E is an example of a portable information terminal including a panel 712B which is curved along a side surface of the housing 711. When a substrate having a curved surface is used as a support substrate of a touch panel and a display element, a portable information terminal including a panel with a curved surface can be obtained.

The portable information terminal 720 in FIG. 22E includes the panel 712B incorporated in the housing 711, the operation button 713, the speaker 714, and a microphone 715. Further, although not shown, the portable information terminal 720 includes a stereo headphone jack, a memory card insertion slot, a camera, an external connection port such as a USB connector, and the like.

The portable information terminals illustrated in FIGS. 22D and 22E each have a function of one or more of a telephone set, an e-book reader, a personal computer, and a game machine.

Figure 22F:
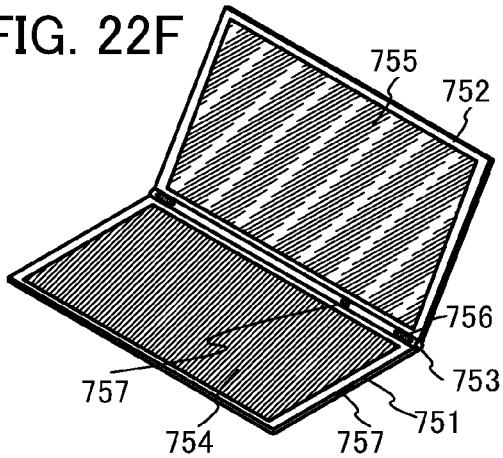

An information processing device illustrated in FIG. 22F is an example of a foldable information terminal.

The information processing device 750 in FIG. 22F includes a housing 751, a housing 752, a panel 754 incorporated in the housing 751, a panel 755 incorporated in the housing 752, a speaker 756, a startup button 757, and a connection terminal 725.

In the information processing device 750 illustrated in FIG. 22F, the housing 751 and the housing 752 are connected to each other with a hinge 753 and can be folded together.

The information processing device in FIG. 22F can be driven by the method described in any of the above embodiments.

For example, input keys of a keyboard or the like can be displayed on the panel 754, and an application displayed on the panel 755 can be operated by combination of touch operation on the input keys and input operation by a gesture toward the panel 754.

The above is the description of the information processing devices illustrated in FIGS. 22A to 22F.

As described with reference to FIGS. 22A to 22F, the information processing device in this embodiment can be driven by the method described in any of the above embodiments. Thus, a variety of input methods can be provided and eye strain on a user can be reduced.

The information processing device described in this embodiment can reduce users' eye strain and perform eye-friendly display by employing the driving method of an information processing device described in Embodiment 1 and making the arithmetic unit execute a program for driving the information processing device as described in Embodiment 1.

This embodiment can be combined with any of the other embodiments disclosed in this specification as appropriate.

This application is based on Japanese Patent Application serial No. 2012-261910 filed with Japan Patent Office on Nov. 30, 2012, the entire contents of which are hereby incorporated by reference.

What is claimed is:

1. A method for driving an information processing device in which image signals are input to first to A-th pixels (A is a natural number greater than or equal to 2), comprising the steps of:

counting pixels to which an image signal having a gray scale level within a set range are input in the first to B-th pixels (B is a natural number smaller than A) of a next image before displaying the next image;

rewriting the first to A-th pixels at a first refresh rate in the case where the number of the counted pixels (CTR) is greater than a set pixel number, and the next image refreshed at the first refresh rate is displayed; and rewriting the first to A-th pixels at a second refresh rate which is lower than the first refresh rate to reduce flicker in the case where the sum of the number of the counted pixels (CTR) and a value (A−B) is smaller than the set pixel number, and the next image refreshed at the second refresh rate is displayed, wherein the counting pixels is stopped at the time point when the number of the counted pixels (CTR) is greater than the set pixel number, and the first to A-th pixels are rewritten at the first refresh rate.

2. The method for driving an information processing device according to claim 1, wherein the first refresh rate is higher than or equal to 30 Hz.

3. The method for driving an information processing device according to claim 1, wherein the second refresh rate is lower than or equal to 1 Hz.

4. The method for driving an information processing device according to claim 1, wherein the first to A-th pixels each have a liquid crystal element.

5. The method for driving an information processing device according to claim 1, wherein the information processing device displays a still image.

6. The method for driving an information processing device according to claim 1, wherein a display portion includes the first to A-th pixels, and wherein light emitted from the display portion includes light with wavelengths longer than 440 nm and does not include light with wavelengths shorter than or equal to 440 nm.

7. The method for driving an information processing device according to claim 1, wherein the counting pixels is stopped at the time point when the sum of the number of the counted pixels and the value (A−B) is lower than or equal to the set pixel number, and the first to A-th pixels are rewritten at the second refresh rate.

8. A method for driving an information processing device in which image signals are input to a plurality of pixels, comprising the steps of:

detecting the proportion of pixels to which image signal having a gray scale level within a set range are input in the plurality of pixels of a next image before displaying the next image;

rewriting the plurality of pixels at a first refresh rate in the case where the detected proportion is greater than a set proportion, and the next image refreshed at the first refresh rate is displayed; and rewriting the plurality of pixels at a second refresh rate which is lower than the first refresh rate to reduce flicker in the case where the detected proportion is smaller than the set proportion, and the next image refreshed at the second refresh rate is displayed, wherein the detecting the proportion of pixels is stopped at the time point when the detected proportion is greater than the set proportion, and the plurality of pixels is rewritten at the first refresh rate.

9. The method for driving an information processing device according to claim 8, wherein the first refresh rate is higher than or equal to 30 Hz.

10. The method for driving an information processing device according to claim 8, wherein the second refresh rate is lower than or equal to 1 Hz.

11. The method for driving an information processing device according to claim 8, wherein the plurality of pixels each have a liquid crystal element.

12. The method for driving an information processing device according to claim 8, wherein the information processing device displays a still image.

13. The method for driving an information processing device according to claim 8, wherein a display portion includes the plurality of pixels, and wherein light emitted from the display portion includes light with wavelengths longer than 440 nm and does not include light with wavelengths shorter than or equal to 440 nm.

14. The method for driving an information processing device according to claim 8, wherein the detecting the proportion of pixels is stopped at the time point when the sum of the detected proportion and a proportion of the rest of pixels that are not detected the rest of the pixels is lower than or equal to the set pixel number, and the plurality of pixels is rewritten at the second refresh rate.

* * * * *